US007775267B2

(12) United States Patent
Higashiyama et al.

(10) Patent No.: US 7,775,267 B2
(45) Date of Patent: Aug. 17, 2010

(54) EVAPORATOR

(75) Inventors: Naohisa Higashiyama, Oyama (JP); Sumitaka Watanabe, Oyama (JP); Shinobu Yamauchi, Oyama (JP); Daisuke Mori, Oyama (JP)

(73) Assignee: Showa Denko K.K., Tokyo (JP)

( * ) Notice: Subject to any disclaimer, the term of this patent is extended or adjusted under 35 U.S.C. 154(b) by 1262 days.

(21) Appl. No.: 10/563,151

(22) PCT Filed: Jul. 8, 2004

(86) PCT No.: PCT/JP2004/010070

§ 371 (c)(1),
(2), (4) Date: Jan. 4, 2006

(87) PCT Pub. No.: WO2005/003671

PCT Pub. Date: Jan. 13, 2005

(65) Prior Publication Data

US 2006/0162376 A1 Jul. 27, 2006

Related U.S. Application Data

(60) Provisional application No. 60/486,899, filed on Jul. 15, 2003.

(30) Foreign Application Priority Data

Jul. 8, 2003 (JP) ..... 2003-272039

(51) Int. Cl.
*F28F 9/02* (2006.01)
*F28D 7/06* (2006.01)

(52) U.S. Cl. ..... 165/176; 165/173

(58) Field of Classification Search ..... 165/173, 165/175, 176, 153; 29/890.052
See application file for complete search history.

(56) References Cited

U.S. PATENT DOCUMENTS 4,582,127 A * 4/1986 Moranne ..... 165/83
5,052,480 A * 10/1991 Nakajima et al. ..... 165/153
5,492,172 A * 2/1996 Laveran et al. ..... 165/173
5,685,366 A * 11/1997 Voss et al. ..... 165/144
6,145,589 A * 11/2000 Gowan ..... 165/174
2002/0074113 A1 * 6/2002 Abell et al. ..... 165/175

FOREIGN PATENT DOCUMENTS

JP 11-101594 4/1999
JP 2002-147992 5/2002
JP 2003-75024 3/2003

OTHER PUBLICATIONS

U.S. Appl. No. 11/571,364, filed Dec. 28, 2006, Higashiyama et al.
U.S. Appl. No. 11/571,938, filed Jan. 11, 2007, Higashiyama.

* cited by examiner

*Primary Examiner*—Tho V Duong
(74) *Attorney, Agent, or Firm*—Oblon, Spivak, McClelland, Maier & Neustadt, L.L.P.

(57) ABSTRACT

An evaporator 1 comprises a heat exchange core 10 comprising a plurality of tube groups 5 arranged in rows as spaced forwardly or rearwardly of the evaporator and each comprising a plurality of heat exchange tubes 4 arranged in parallel at a spacing laterally of the evaporator, and a lower tank 3 disposed at a lower end of the core 10 and having connected thereto lower ends of the heat exchange tubes 4 providing the tube groups 5. The lower tank 3 has a top surface 3*a*, front and rear opposite side surfaces 3*b* and a bottom surface 3*c*. The lower tank 3 is provided in each of front and rear opposite side portions thereof with grooves 29 formed between respective laterally adjacent pairs of heat exchange tubes 4 and extending from an intermediate portion of the top surface 3*a* with respect to the forward or rearward direction to the side surface 3*b* for causing water condensate to flow therethrough. Each of the grooves 29 includes a first portion 29*a* existing on the top surface 3*a* of the lower tank and having a bottom face which is gradually lowered from the intermediate portion of the top surface 3*a* toward a front or rear side edge thereof. The evaporator 1 can be diminished in the quantity of water condensate that will collect on the top surface 3*a* of the lower tank 3.

23 Claims, 15 Drawing Sheets

EVAPORATOR

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/486,899 filed Jul. 15, 2003 pursuant to 35 U.S.C. §111(b).

TECHNICAL FIELD

The present invention relates to evaporators, and more particularly to an evaporator comprising a heat exchange core comprising a plurality of tube groups arranged in rows as spaced forwardly or rearwardly of the evaporator and each comprising a plurality of heat exchange tubes arranged in parallel at a spacing laterally of the evaporator, and a lower tank disposed at the lower end of the core and having connected thereto the lower ends of the heat exchange tubes providing the tube groups.

In this specification and the appended claims, the upper and lower sides and the left-hand and right-hand sides of FIG. 1 and FIG. 2 will be referred to respectively as "upper," "lower," "left" and "right," the downstream side (the direction indicated by the arrow X in FIG. 1, the right-hand side of FIG. 3) of flow of air through an air passing clearance between each adjacent pair of heat exchange tubes of the tube groups will be referred to as "front," and the opposite side thereof as "rear."

Further the term "aluminum" as used herein includes aluminum alloys in addition to pure aluminum.

BACKGROUND ART

Heretofore in wide use as motor vehicle evaporators are those of the so-called stacked plate type which comprise a plurality of flat hollow bodies arranged in parallel and each composed of a pair of dishlike plates facing toward each other and brazed to each other along peripheral edges thereof, and a louvered corrugated fin disposed between and brazed to each adjacent pair of flat hollow bodies. In recent years, however, it has been demanded to provide evaporators further reduced in size and weight and exhibiting higher performance.

To meet such a demand, evaporators have been proposed which comprise a pair of upper and lower tanks arranged as spaced apart vertically, and a plurality of tube groups arranged in two rows as spaced apart forwardly or rearwardly of the evaporator between the pair of tanks and each comprising a plurality of heat exchange tubes arranged in parallel at a spacing laterally of the evaporator, the heat exchange tubes of each tube group having upper and lower ends connected respectively to the upper and lower tanks, a louvered corrugated fin being disposed in an air passing clearance between each adjacent pair of heat exchange tubes of each tube group, the lower tank having a horizontal flat top wall (see, for example, the publication of JP-A No. 2001-324290), or the lower tank having a top wall wherein an intermediate portion with respect to the forward or rearward direction is highest and which is so shaped that the highest portion is gradually lowered toward both the front and rear sides (see, for example, the publication of JP-A No. 2003-75024).

The evaporators disclosed in these two publications are made smaller in size and weight and exhibit higher performance than evaporators of the stacked plate type, and are therefore increased in the amount of water condensate produced relative to the heat transfer area.

Consequently, a relatively larger quantity of water condensate becomes collected between the top wall of the lower tank and the lower ends of the corrugated fins, and is likely freeze to result in impaired evaporator performance.

An object of the present invention is to overcome the above problem and to provide an evaporator which is reduced in the amount of water condensate that will collect on the top wall of the lower tank.

DISCLOSURE OF THE INVENTION

To fulfill the above object, the present invention comprises the following modes.

1) An evaporator comprising a heat exchange core comprising a plurality of tube groups arranged in rows as spaced forwardly or rearwardly of the evaporator and each comprising a plurality of heat exchange tubes arranged in parallel at a spacing laterally of the evaporator, and a lower tank disposed at a lower end of the core and having connected thereto lower ends of the heat exchange tubes providing the tube groups, the lower tank having a top surface, front and rear opposite side surfaces and a bottom surface and being provided in each of front and rear opposite side portions thereof with grooves formed between respective laterally adjacent pairs of heat exchange tubes and extending from an intermediate portion of the top surface with respect to the forward or rearward direction to the side surface for causing water condensate to flow therethrough.

2) An evaporator described in the above para. 1) wherein the grooves have a capillary effect to draw the condensate on the surface of the lower tank into the groove.

3) An evaporator described in the above para. 1) wherein each of the grooves includes a first portion existing on the top surface of the lower tank, and the first portion has a bottom face gradually lowered from the intermediate portion of the top surface toward a front or rear side edge thereof.

4) An evaporator described in the above para. 1) wherein the top surface of the lower tank is highest at the intermediate portion and is so shaped as to lower gradually from the highest portion toward the side surface, and each of the grooves extends from the front or rear side of the highest portion of the lower tank top surface to the side surface of the lower tank.

5) An evaporator described in the above para. 4) wherein each of the grooves includes a first portion existing on the lower tank top surface, and the first portion has the same depth over the entire length of the first portion.

6) An evaporator described in the above para. 4) wherein each of the grooves includes a first portion existing on the lower tank top surface, and the first portion has a depth gradually increasing from the highest portion side of the top surface toward the side surface.

7) An evaporator described in the above para. 4) wherein each of the grooves includes a first portion existing on the lower tank top surface, and the first portion has a depth of 0.5 to 2.0 mm.

8) An evaporator described in the above para. 4) wherein each of the grooves includes a first portion existing on the lower tank top surface, and the first portion has a groove width gradually increasing from a bottom of the groove toward an opening thereof.

9) An evaporator described in the above para. 8) wherein the first portion of each groove is 0.067 to 0.33 in the ratio L1/L2 of the width L1 of the groove bottom to the width L2 of the opening.

10) An evaporator described in the above para. 1) wherein the top surface of the lower tank is in the form of a horizontal flat surface.

11) An evaporator described in the above para. 10) wherein each of the grooves includes a first portion existing on the lower tank top surface, and the first portion has a groove width gradually increasing from a bottom of the groove toward an opening thereof.

12) An evaporator described in the above para. 1) wherein each of the grooves has a flat bottom face.

13) An evaporator described in the above para. 1) wherein each of the grooves has a bottom face shaped to a circular-arc cross section which is recessed toward a widthwise midportion of a bottom of the groove.

14) An evaporator described in the above para. 13) wherein the bottom face of each groove has a radius of curvature which is ½ of the width of the groove bottom.

15) An evaporator described in the above para. 1) wherein each of the grooves has a first portion existing on the lower tank top surface, and the ratio W2/W1 of the straight distance W2 between front and rear ends of the first portion to the entire width W1 of the lower tank in the forward or rearward direction is 0.16 to 0.47.

16) An evaporator described in the above para. 1) wherein each of the grooves includes a second portion existing at a junction of the top surface of the lower tank and the side surface thereof, and the second portion has a bottom face inclined downward forwardly or rearwardly outward.

17) An evaporator described in the above para. 16) wherein the bottom face of the second portion of each groove has an angle of inclination of 20 to 50 deg with a vertical plane.

18) An evaporator described in the above para. 16) wherein each of the grooves includes a first portion existing on the top surface of the lower tank and having a bottom face, and in a longitudinal section of the groove, the bottom face of the first portion is shaped in the form of a circular arc extending from the highest portion side of the top surface of the lower tank forwardly or rearwardly outward as curved downward, the angle of inclination of a straight line through front and rear ends of the first portion bottom face with a vertical plane being smaller than the angle of inclination of the second portion bottom face with a vertical plane.

19) An evaporator described in the above para. 1) wherein each of the grooves includes a third portion existing on the side surface of the lower tank, and the third portion has a vertical bottom face.

20) An evaporator described in the above para. 1) wherein each of the grooves includes a third portion existing on the side surface of the lower tank, and the third portion has a depth of 0.3 to 0.8 mm.

21) An evaporator described in the above para. 1) wherein each of the grooves has a third portion having the same width from a bottom of the groove to an opening thereof.

22) An evaporator described in the above para. 21) wherein the third portion of each groove has a width of 0.5 to 1.5 mm.

23) An evaporator comprising a heat exchange core having a plurality of heat exchange tubes arranged laterally of the evaporator at a spacing, and a lower tank disposed at a lower end of the core and having connected thereto lower ends of the heat exchange tubes, the lower tank having a top surface, front and rear opposite side surfaces and a bottom surface and being provided on at least one of the front and rear side surfaces thereof with a plurality of grooves extending vertically and arranged laterally of the evaporator at a spacing for causing water condensate to flow therethrough.

24) An evaporator described in the above para. 23) wherein the grooves are formed in each of the front and rear side surfaces of the lower tank.

25) An evaporator described in the above para. 23) wherein the entire top surface of the lower tank has a portion at least closer to each of front and rear opposite side edges thereof and lowered forwardly or rearwardly outward.

26) An evaporator described in the above para. 23) wherein the top surface of the lower tank is highest at an intermediate portion with respect to the forward or rearward direction and is so shaped as to lower gradually from the highest portion toward a front or rear side.

27) An evaporator described in the above para. 23) wherein the grooves have a capillary effect to draw the condensate on the surface of the lower tank into the groove.

28) An evaporator described in the above para. 23) wherein each of the grooves has a vertical bottom face.

29) An evaporator described in the above para. 23) wherein each of the grooves has a depth of 0.3 to 0.8 mm.

30) An evaporator described in the above para. 23) wherein each of the grooves has the same width from a bottom of the groove to an opening thereof.

31) An evaporator described in the above para. 30) wherein each of the grooves has a width of 0.5 to 1.5 mm.

32) An evaporator described in the above para. 23) wherein each of the grooves has a flat bottom face.

33) An evaporator described in the above para. 23) wherein each of the grooves has a bottom face shaped to a circular-arc cross section which is recessed toward a widthwise midportion of a bottom of the groove.

34) An evaporator described in the above para. 33) wherein the bottom face of each groove has a radius of curvature which is ½ of the width of the groove bottom.

35) A refrigeration cycle comprising a compressor, a condenser and an evaporator, the evaporator comprising an evaporator described in the above para. 1) or 23).

36) A vehicle having installed therein a refrigeration cycle described in the above para. 35) as an air conditioner.

The present invention further includes the following modes.

a) An evaporator comprising a heat exchange core comprising a plurality of tube groups arranged in rows as spaced forwardly or rearwardly of the evaporator and each comprising a plurality of heat exchange tubes arranged in parallel at a spacing laterally of the evaporator, and a lower tank disposed at a lower end of the core and having connected thereto lower ends of the heat exchange tubes providing the tube groups, the lower tank having a top surface, front and rear opposite side surfaces and a bottom surface, the top surface of the lower tank being highest at an intermediate portion with respect to the forward or rearward direction and being so shaped as to lower gradually from the highest portion toward the front and rear side surfaces, a junction of the top surface of the lower tank and each of the front and rear side surfaces thereof being provided with grooves for passing water condensate therethrough.

b) An evaporator described in the above para. a) wherein the grooves have a capillary effect to draw the condensate on the surface of the lower tank into the groove.

c) An evaporator described in the above para. a) wherein each of the grooves has a bottom face downwardly inclined as the groove extends forwardly or rearwardly outward.

d) An evaporator described in the above para. c) wherein the bottom face of each groove has an angle of inclination of 20 to 50 deg with a vertical plane.

e) An evaporator described in the above para. a) wherein each of the grooves has a width gradually increasing from a bottom of the groove toward an opening thereof.

f) An evaporator described in the above para. e) wherein each of the grooves is 0.067 to 0.33 in the ratio L1/L2 of the width L1 of the groove bottom to the width L2 of the opening.

g) An evaporator described in the above para. a) wherein each of the grooves has a depth of 0.5 to 2.0 mm.

h) An evaporator described in the above para. a) wherein each of the grooves has a flat bottom face.

i) An evaporator described in the above para. a) wherein each of the grooves has a bottom face shaped to a circular-arc cross section which is recessed toward a widthwise midportion of a bottom of the groove.

j) An evaporator described in the above para. i) wherein the bottom face of each groove has a radius of curvature which is ½ of the width of the groove bottom.

When water condensate is produced on the surfaces of the corrugated fins of the evaporator described in the para. 1), the condensate flows down onto the top surface of the lower tank, ingresses into grooves, flows through the grooves and falls below the lower tank from the lower ends of groove portions existing on the front and rear side surfaces. In this way, a large quantity of the condensate is prevented from collecting between the lower tank top surface and the lower ends of the corrugated fins and is consequently precluded from freezing due to the presence of large amount of the condensate. As a result, the evaporator exhibits satisfactory performance without impairment.

With the evaporator described in the para. 2), the condensate on the top surface of the lower tank ingresses into the grooves by virtue of a capillary effect and therefore flows into the grooves easily, hence an improved drainage effect.

With the evaporator described in the para. 3), the condensate ingressing into the groove first portion flows smoothly.

With the evaporators described in the para. 4) to 6), the condensate flowing down onto the lower tank top surface further flows down the tank top surface, enters the groove first portions by virtue of the capillary effect while flowing down, flows through the grooves and falls below the lower tank from the lower ends of groove portions existing on the front and rear side surfaces. This prevents a large quantity of condensate from collecting between the lower tank top surface and the fin lower ends, consequently precluding the condensate from freezing due to the collection of large quantity of the condensate.

With the evaporator described in the para. 7), the condensate ingressing into grooves flows smoothly along the grooves.

With the evaporators described in the para. 8) and 9), the condensate collecting on the lower tank top surface flows into the grooves easily.

When water condensate is produced on the surfaces of the corrugated fins of the evaporator described in the para. 10), the condensate reaching the top surface of the lower tank ingresses into groove first portions by virtue of a capillary effect, flows through the grooves and falls below the lower tank from the lower ends of groove portions existing on the front and rear side surfaces. In this way, a large quantity of the condensate is prevented from collecting between the lower tank top surface and the lower ends of the corrugated fins and is consequently precluded from freezing due to the presence of large amount of the condensate. This precludes inefficient performance of the evaporator.

With the evaporator described in the para. 11), the condensate collecting on the lower tank top surface flows into the grooves easily.

The evaporator described in the para. 12) has a corner at the junction of the bottom face of the groove and each side surface, and the corner produces a capillary effect, whereby the condensate is allowed to flow into the groove easily.

With the evaporators described in the para. 13) and 14), the circular-arc bottom face of the groove produces a capillary effect, permitting the condensate to flow into the groove easily.

With the evaporators described in the para. 16) to 18), the condensate in groove first portions promptly flows into second portions by virtue of a capillary effect and is run off via portions existing in each of the front and rear side surfaces.

With the evaporators described in the para. 19) and 22), the condensate can be allowed to fall off from the groove to below the lower tank efficiently.

When water condensate is produced on the surfaces of the corrugated fins of the evaporators described in the para. 23) and 24), the condensate reaching the top surface of the lower tank ingresses into grooves, flows through the grooves and falls below the lower tank. In this way, a large quantity of the condensate is prevented from collecting between the lower tank top surface and the lower ends of the corrugated fins and is consequently precluded from freezing due to the presence of large amount of the condensate. This precludes inefficient performance of the evaporator.

When water condensate is produced on the surfaces of the corrugated fins of the evaporators described in the para. 25) and 26), the condensate reaching the top surface of the lower tank flows along the top surface to each of the front and rear side edges, ingresses into grooves, flows through the grooves and falls below the lower tank. In this way, a large quantity of the condensate is prevented from collecting between the lower tank top surface and the lower ends of the corrugated fins and is consequently precluded from freezing due to the presence of large amount of the condensate. This precludes inefficient performance of the evaporator.

With the evaporator described in the para. 27), the condensate flowing along the lower tank top surface ingresses into grooves by virtue of a capillary effect, and therefore flows into the grooves easily, consequently achieving an improved drainage effect.

With the evaporators described in the para. 28) to 31), the condensate can be allowed to fall off from grooves to below the lower tank efficiently.

The evaporator described in the para. 32) has a corner at the junction of the bottom face of the groove and each side surface, and the corner produces a capillary effect, whereby the condensate is allowed to flow into the groove easily.

With the evaporators described in the para. 33) and 34), the circular-arc bottom face of the groove produces a capillary effect, permitting the condensate to flow into the groove easily.

When water condensate is produced on the surfaces of the corrugated fins of the evaporator described in the para. a), the condensate reaching the top surface of the lower tank flows along the top surface to each of the front and rear side edges, ingresses into grooves, flows through the grooves and falls from each of the front and rear side surfaces of the lower tank. In this way, a large quantity of the condensate is prevented from collecting between the lower tank top surface and the lower ends of the corrugated fins and is consequently precluded from freezing due to the presence of large amount of the condensate. This precludes inefficient performance of the evaporator.

With the evaporator described in the para. b), the condensate flowing along the lower tank top surface ingresses into grooves by virtue of a capillary effect, and therefore flows into the grooves easily, consequently achieving an improved drainage effect.

With the evaporator described in the para. c), the condensate ingressing into the groove flows smoothly.

With the evaporator described in the para. d), the condensate flowing on the lower tank top surface promptly flows into the groove by virtue of a capillary effect, flows through the groove and falls off from each of the front and rear side surfaces of the lower tank.

With the evaporators described in the para. e) and f), the condensate flowing along the lower tank top surface flows into the groove easily.

With the evaporator described in the para. g), the condensate ingressing into the groove flows along the groove easily.

The evaporator described in the para. h) has a corner at the junction of the bottom face of the groove and each side surface, and the corner produces a capillary effect, whereby the condensate is allowed to flow into the groove easily.

With the evaporators described in the para. i) and j), the circular-arc bottom face of the groove produces a capillary effect, permitting the condensate to flow into the groove easily.

BEST MODE OF CARRYING OUT THE INVENTION

Embodiments of the present invention will be described below with reference to the drawings.

Figure 1:
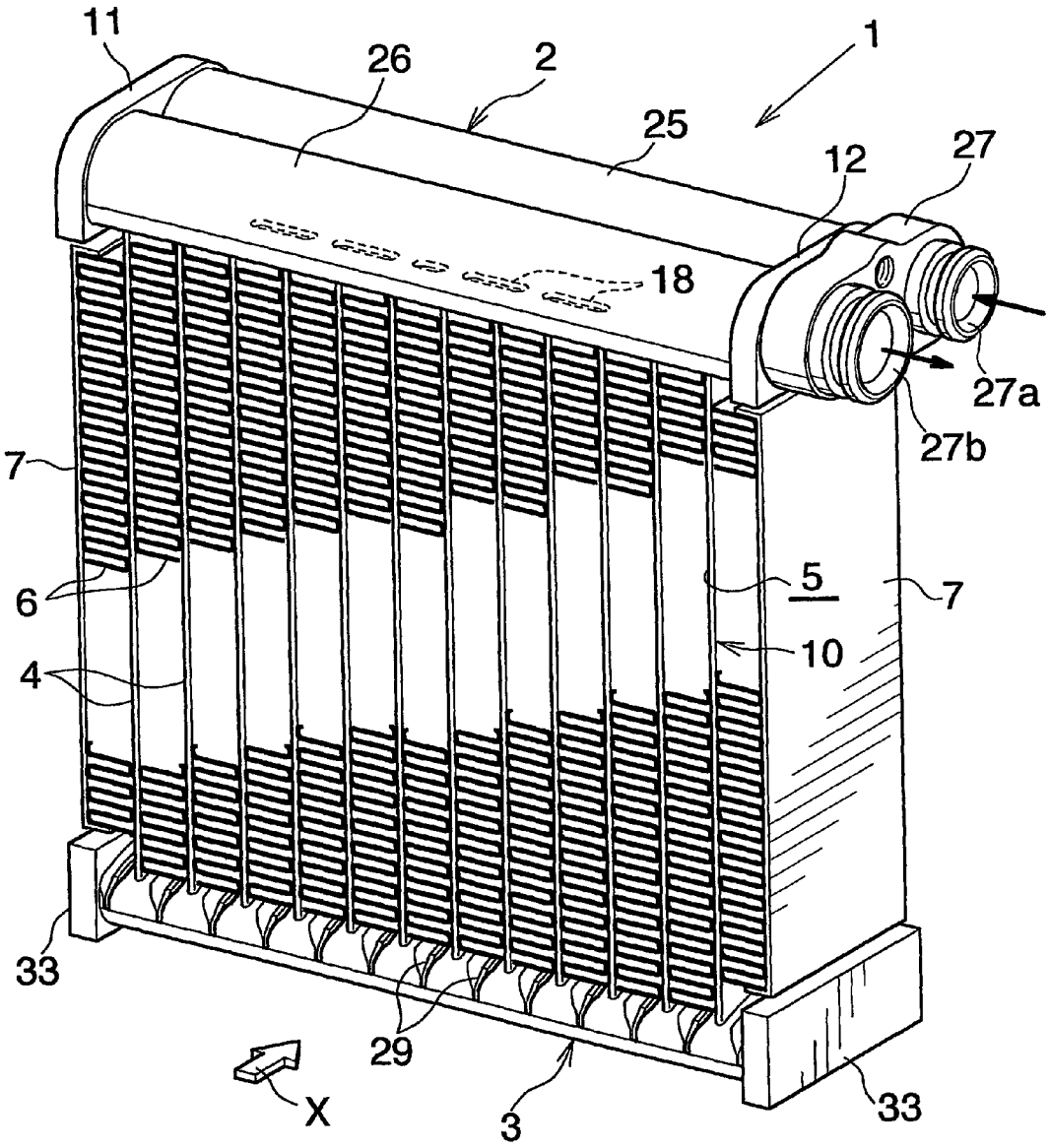
FIG. 1 is a perspective view showing the overall construction of an evaporator embodying the invention.
Figure 2:
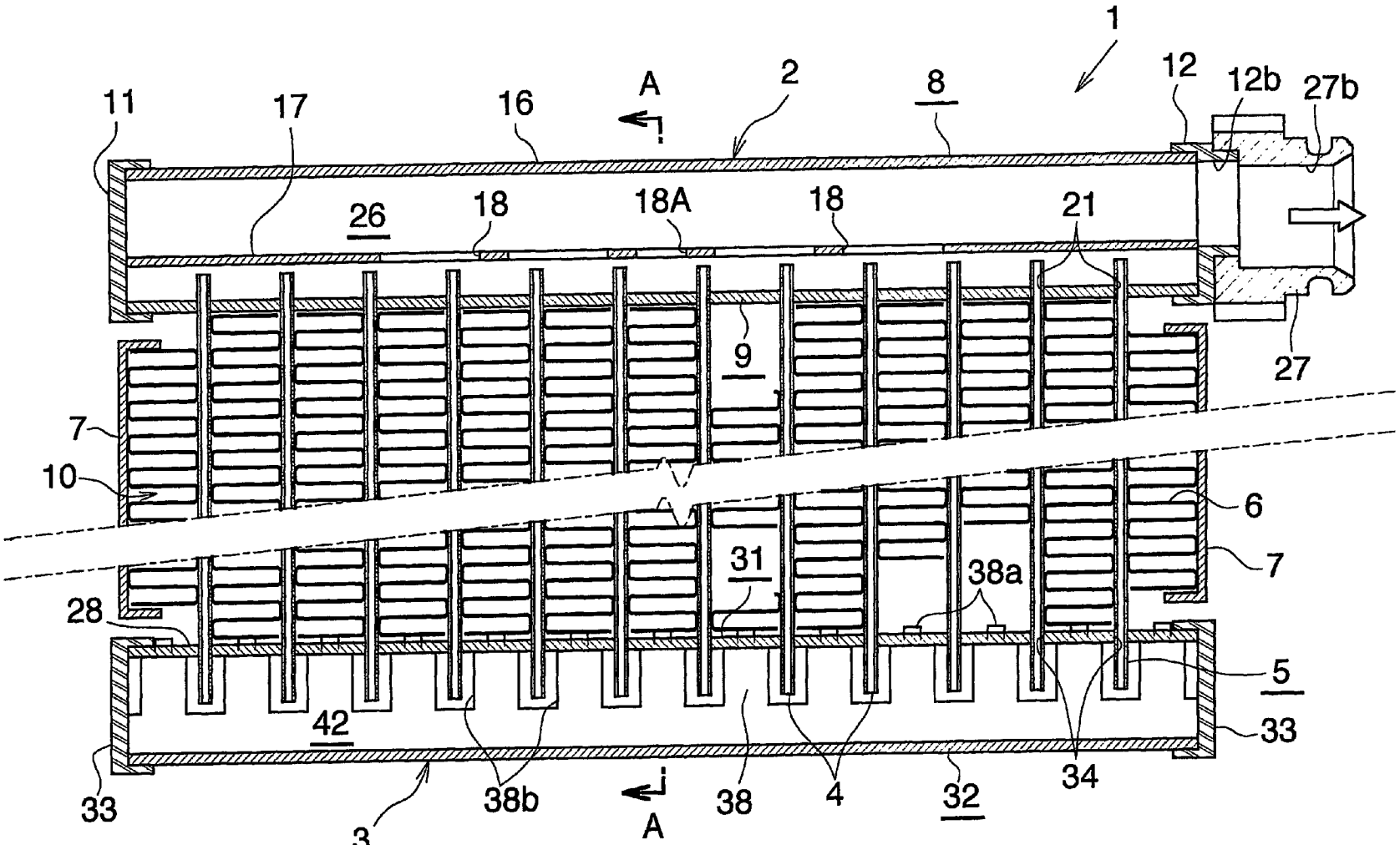
FIG. 2 is a view in vertical section partly broken away and showing the overall construction of the evaporator of the invention as it is seen from the rear.
Figure 7:
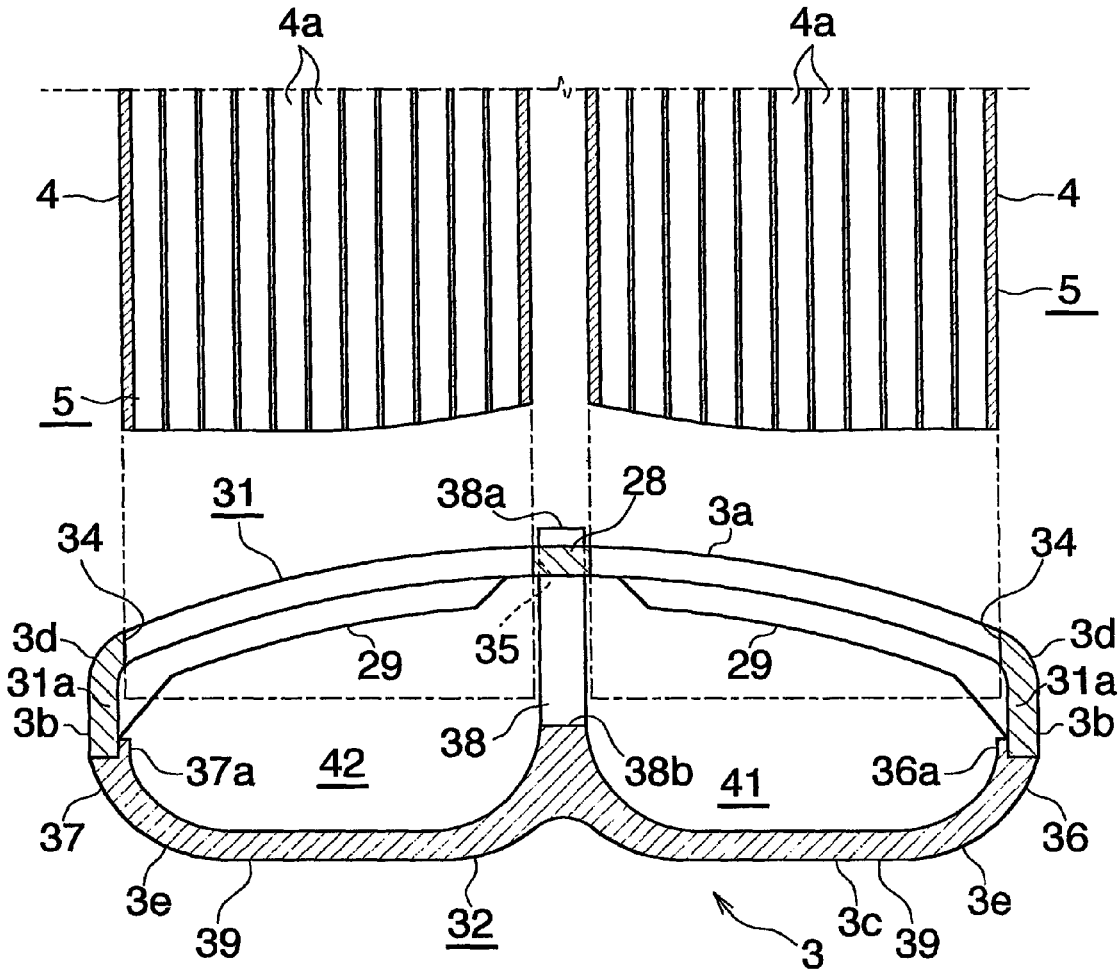
FIG. 7 is a view in section taken along the line D-D in FIG. 6 and partly broken away.
Figure 8:
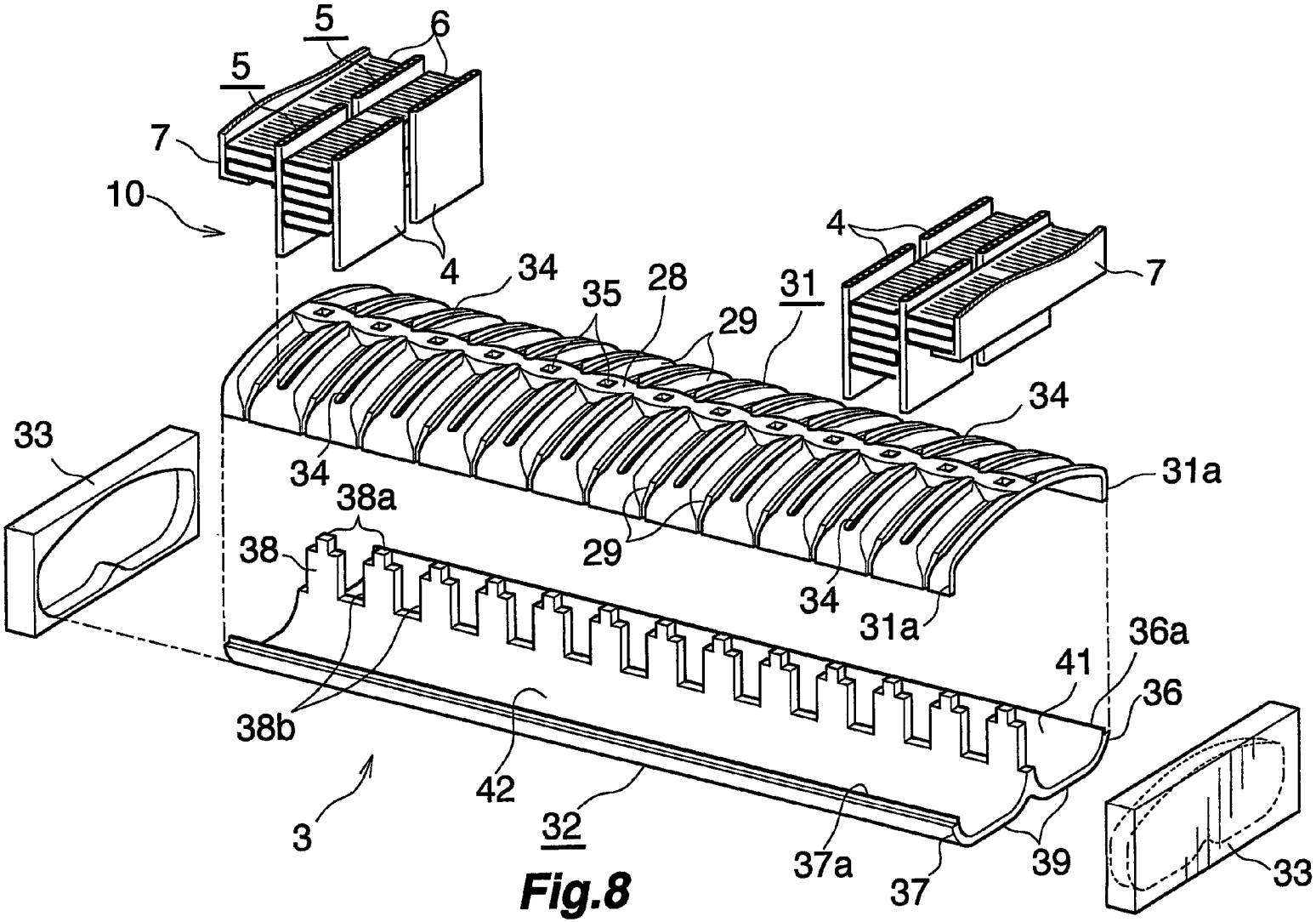
FIG. 8 is an exploded perspective view of a lower tank.
Figure 9:
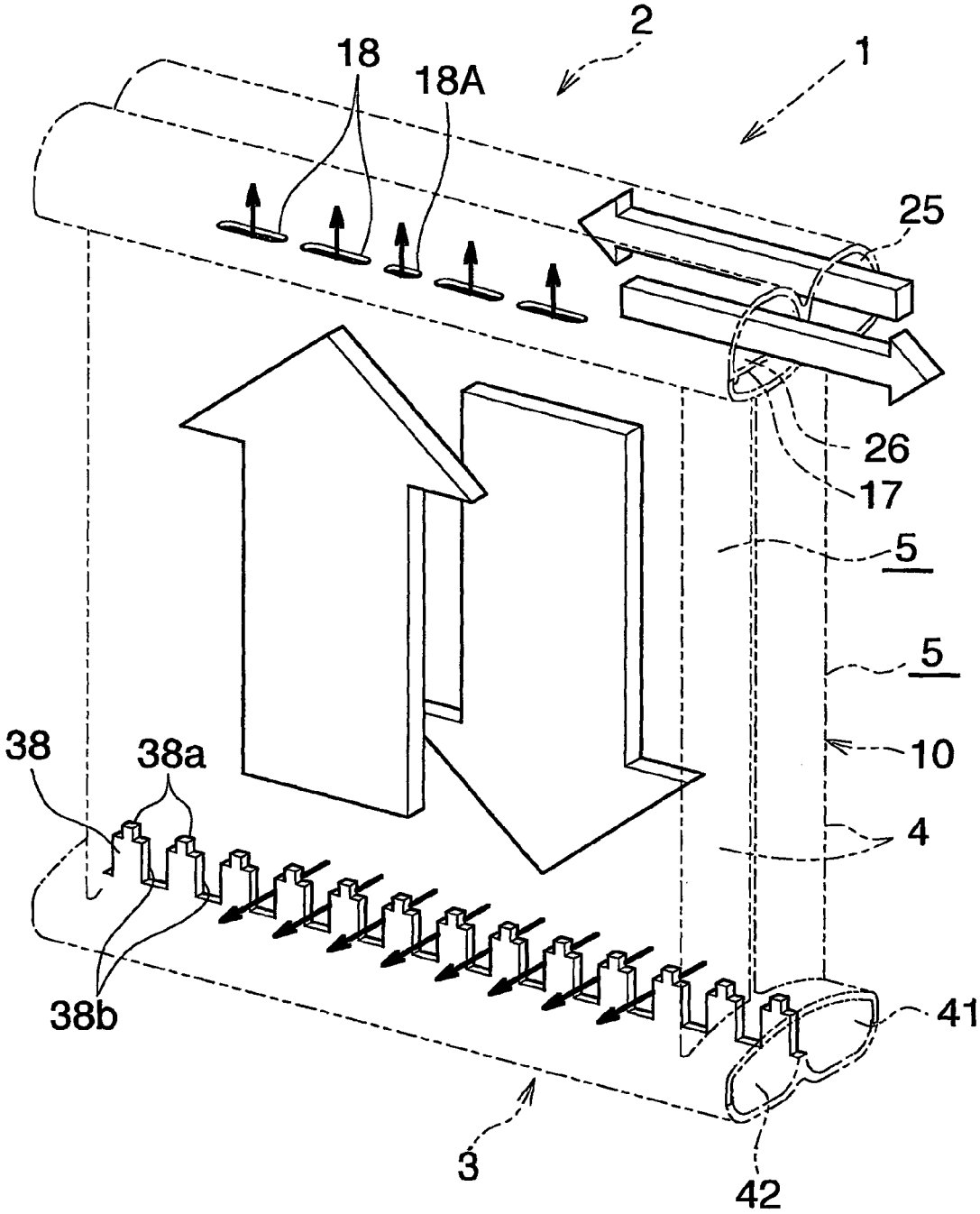
FIG. 9 is a diagram showing how a refrigerant flows through the evaporator of FIG. 1.

FIGS. 1 and 2 show the overall construction of an evaporator embodying the invention, FIGS. 3 to 8 show the constructions of main portions, and FIG. 9 shows how a refrigerant flows through the evaporator of the invention.

Figure 3:
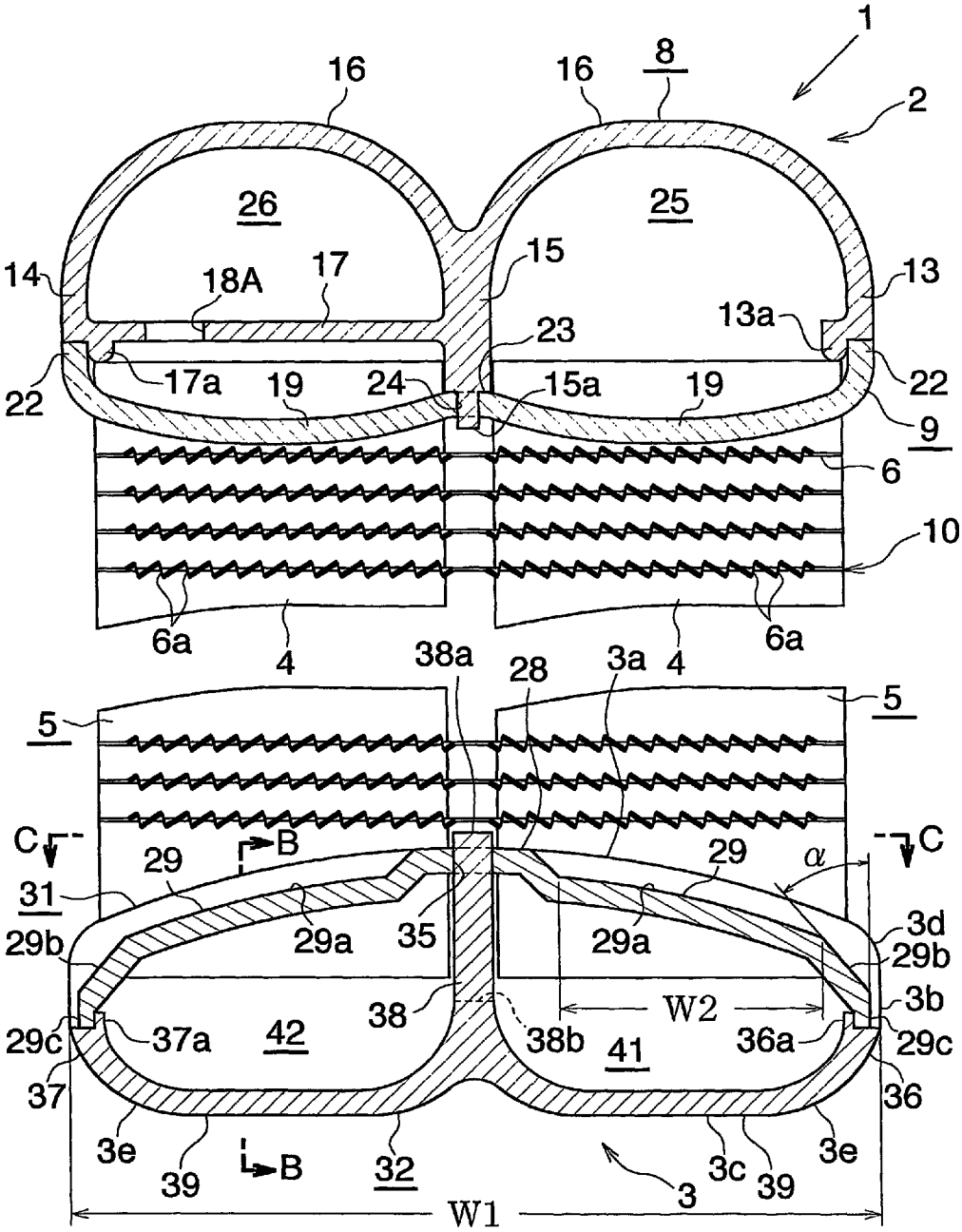
FIG. 3 is an enlarged view in section taken along the line A-A in FIG. 2.

With reference to FIGS. 1 to 3, the evaporator 1 comprises a pair of upper and lower aluminum tanks 2, 3 arranged as spaced apart vertically, and a plurality of tube groups 5 in the form of at least two rows, i.e., two rows in the present embodiment, as spaced forwardly or rearwardly of the evaporator between the pair of tanks 2, 3 and each comprising a plurality of heat exchange aluminum tubes 4 arranged in parallel at a spacing laterally of the evaporator, the heat exchange tubes 4 of each tube group 5 having upper and lower ends connected respectively to the upper and lower tanks 2, 3. A corrugated aluminum fin 6 is disposed in an air passing clearance between each adjacent pair of heat exchange tubes 4 of each tube group 5 and brazed to the pair of tubes 4. The two tube groups 5 and the corrugated fins 6 therein provide a heat exchange core 10. A corrugated aluminum fin 6 is disposed also externally of and brazed to the heat exchange tube 4 at each of opposite left and right ends of each tube group 5, and an aluminum side plate 7 is disposed externally of and brazed to the end corrugated fin 6.

The upper tank 2 comprises an upper member 8 of bare aluminum extrudate, a platelike lower member 9 made of aluminum brazing sheet and brazed to the upper member 8, and aluminum caps 11, 12 closing respective left and right end openings.

Figure 4:
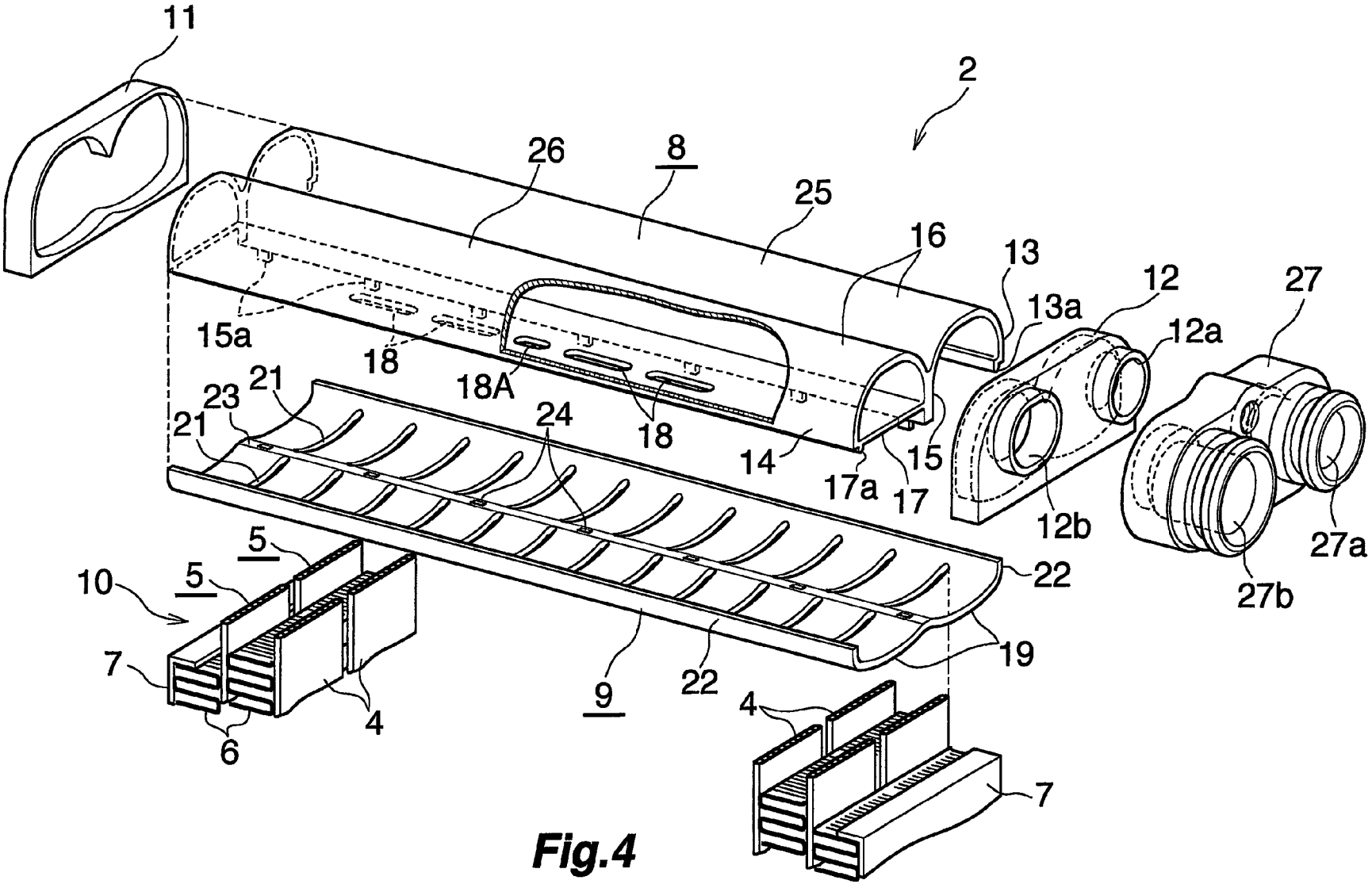
FIG. 4 is an exploded perspective view of an upper tank.
Figure 5:
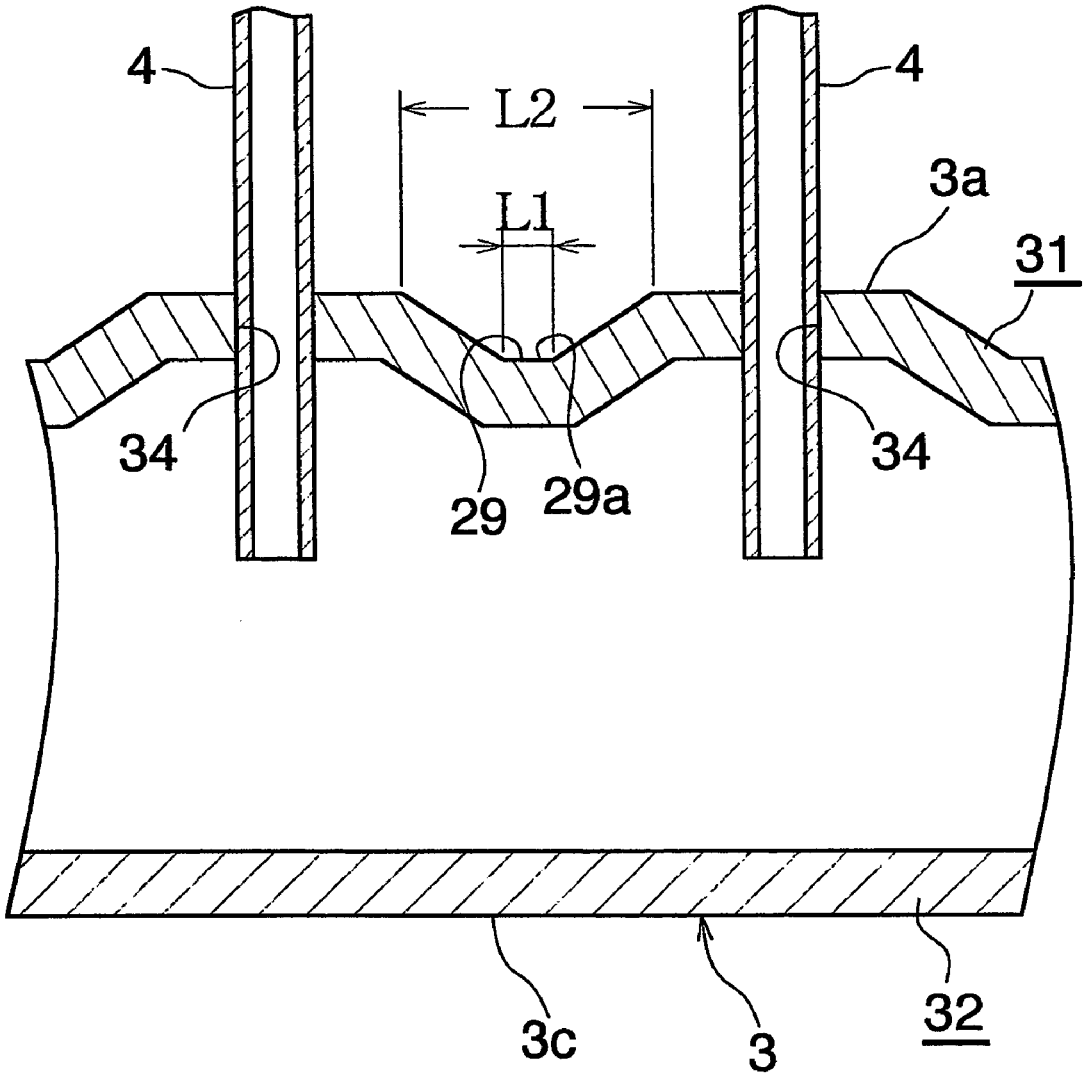
FIG. 5 is an end view in section taken along the line B-B in FIG. 3.
Figure 6:
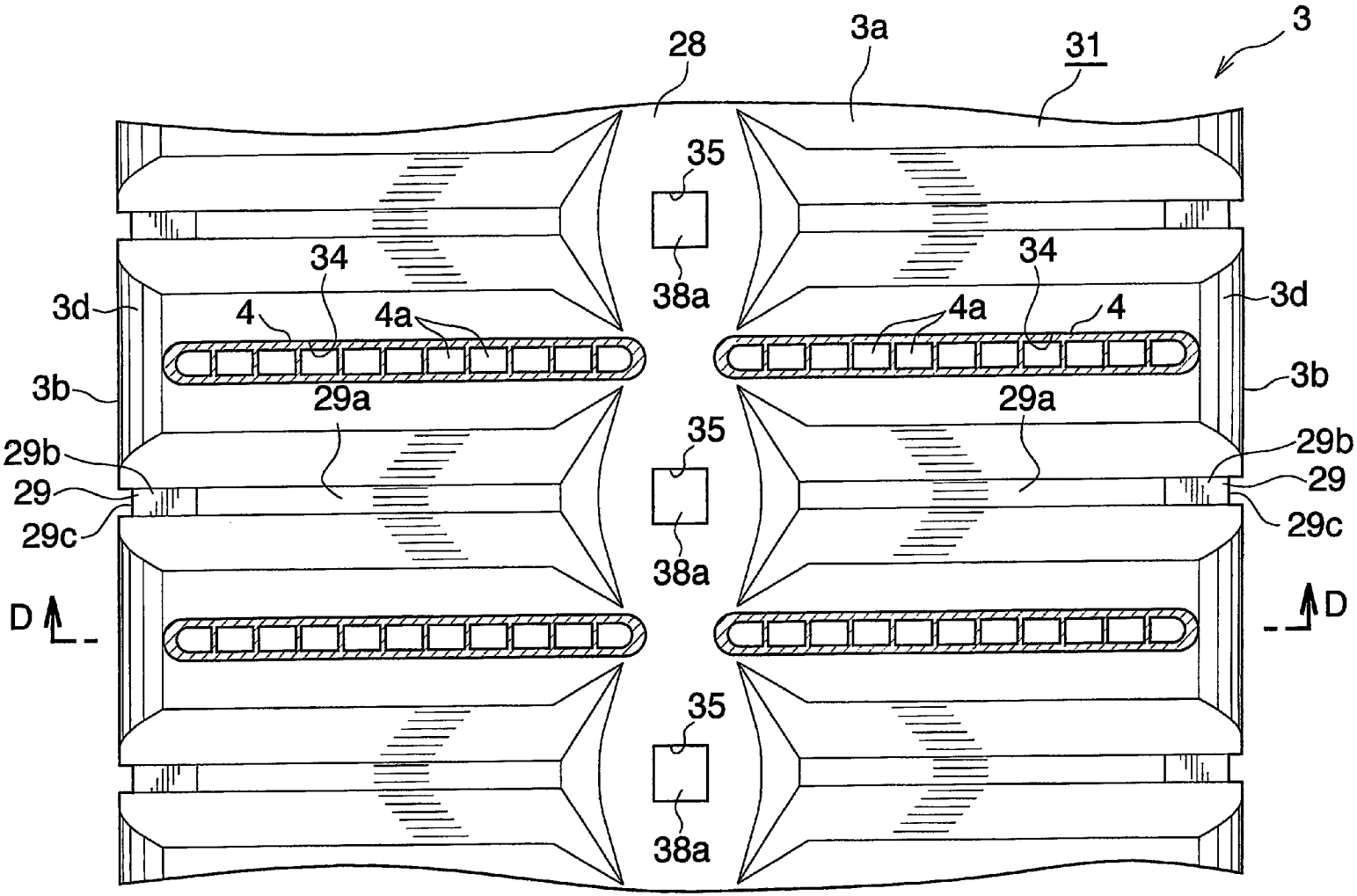
FIG. 6 is a view in section taken along the line C-C in FIG. 3.

With reference to FIGS. 3 and 4, the upper member 8 is generally m-shaped in cross section and opened downward and comprises front and rear two walls 13, 14 extending laterally, an intermediate wall 15 provided in the midportion between the two walls 13, 14 and extending laterally to divide the interior of the upper tank 2 into front and rear two spaces, and two generally circular-arc connecting walls 16 bulging upward and integrally connecting the intermediate wall 15 to the respective front and rear walls 13, 14 at their lower ends. The rear wall 14 and the intermediate wall 15 are integrally interconnected at their lower ends by an uneven flow preventing plate 17 over the entire length of the member 8. Alternatively, a plate separate from the rear wall 14 and the intermediate wall 15 may be secured to these walls 14, 15 as the plate 17. The resistance plate 17 has laterally elongated refrigerant passing through holes 18, 18A formed therein in a rear portion thereof other than the left and right end portions of the plate and arranged at spacing laterally thereof. The refrigerant passing hole 18A in the lateral midportion of the plate 17 has a length smaller than the spacing between adjacent heat exchange tubes 4 of the rear tube group 5, and is formed between the adjacent two heat exchange tubes 4 in the lateral middle of the rear tube group 5. The other refrigerant passing holes 18 have a larger length than the hole 18A. The resistance plate 17 is provided at a rear edge portion of its lower surface with a downwardly projecting ridge 17*a* integral therewith and extending over the entire length thereof. The front wall 13 is integrally provided at the lower edge of its inner surface with a ridge 13*a* projecting downward. The intermediate wall 15 has a lower end projecting downward beyond the lower ends of the ridges 13*a*, 17*a* and integrally provided with a plurality of projections 15*a*, these projections 15*a* projecting downward from its lower edge and arranged at a spacing in the lateral direction. The projections 15*a* are formed by cutting away specified portions of the intermediate wall 15.

The lower member 9 has at each of the front and rear side portions thereof a curved portion 19 in the form of a circular arc of small curvature in cross section and bulging downward at its midportion. The curved portion 19 has a plurality of tube insertion slits 21 elongated forward or rearward and arranged at a spacing in the lateral direction. Each corresponding pair of slits 21 in the front and rear curved portions 19 are in the same position with respect to the lateral direction. The front edge of the front curved portion 19 and the rear edge of the rear curved portion 19 are integrally provided with respective upstanding walls 22 extending over the entire length of the member 9 and engaging respectively with the ridges 13*a*, 17*a* of the upper member 8. The lower member 9 includes between the two curved portions 19 a flat portion 23 having a plurality of through holes 24 arranged at a spacing in the lateral direction for the projections 15*a* of the upper member 8 to fit in.

The upper and lower members 8, 9 are brazed to each other with the projections 15*a* of the upper member 8 inserted in the respective holes 24 in crimping engagement with the member 9 and with the upstanding walls 22 of the lower member 9 engaged with the ridges 13*a*, 17*a* of the upper member 9. The portion of the resulting assembly forwardly of the intermediate wall 15 of the upper member 8 serves as a refrigerant inflow header 25, and the portion thereof rearward from the intermediate wall 15 as a refrigerant outflow header 26.

The caps 11, 12 are made from a bare material as by press work, forging or cutting, each have a recess facing laterally inward for the corresponding ends of the upper and lower members 8, 9 to fit in, and are brazed to the upper and lower members 8, 9 with a sheet of brazing material. The right cap 12 has a refrigerant inflow opening 12*a* in communication with the refrigerant inflow header 25, and a refrigerant outflow opening 12*b* communicating with the upper portion of the interior of the refrigerant outflow header 26 above the resistance plate 17. Brazed to the right cap 12 is a refrigerant inlet-outlet member 27 having a refrigerant inlet 27*a* communicating with the refrigerant inflow opening 12*a* and a refrigerant outlet 27*b* communicating with the refrigerant outflow opening 12*b*.

With reference to FIG. 3 and FIGS. 5 to 8, the lower tank 3 has a top surface 3*a*, front and rear opposite side surfaces 3*b* and a bottom surface 3*c*. The top surface 3*a* of the lower tank 3 is circular-arc in cross section in its entirety such that the midportion thereof with respect to the forward or rearward direction is the highest portion 28 which is gradually lowered toward the front and rear sides. The lower tank 3 is provided in its front and rear opposite side portions with grooves 29 extending from the front and rear opposite sides of the highest portion 28 of the top surface 3*a* to the front and rear opposite side surfaces 3*b*, respectively, and arranged laterally at a spacing. Each groove 29 has a flat bottom face.

Each groove 29 has a first portion 29*a* existing on the top surface 3*a* of the lower tank 3 and having the same depth over the entire length of this portion. Opposite side faces defining the first portion 29*a* of the groove 29 are inclined upwardly outward away from each other laterally of the lower tank, and the width of the first portion 29*a* of the groove 29 gradually increases from the bottom of the groove toward the opening thereof. The ratio of the width L1 of the groove at its bottom to the width L2 of the opening, i.e., L1/L2, is preferably 0.067 to 0.33 (see FIG. 5). If this ratio L1/L2 is outside the range of 0.067 to 0.33, the groove 29 has a reduced capillary effect, making it difficult for water condensate to ingress into the first portion 29*a*. The first portion 29*a* of each groove 29 is preferably 0.5 to 2.0 mm in depth. If this depth is less than 0.5 mm, a film of condensate will be formed over the top surface 3*a* to cover the grooves 29, and the condensate is likely to encounter difficulty in flowing into the first portions 29*a*. If the depth is over 2.0 mm, an excess of condensate will collect in the first portions 29*a* and is likely to freeze. The ratio of the straight distance W2 between the front and rear ends of the groove first portion 29*a* to the entire width W1 of the lower tank 3 in the forward or rearward direction, i.e., W2/W1, is preferably 0.16 to 0.47 (see FIG. 3). Further in the longitudinal section of each groove 29, the bottom face of the first portion 29*a* is shaped in the form of a circular arc extending from the highest portion (28) side of the lower tank top surface 3*a* forwardly or rearwardly outward as curved downward (see FIG. 3). The circular-arc bottom face is preferably 18 to 54.5 mm in the radius of curvature.

The groove 29 has a second portion 29*b* existing at the junction 3*d* of the top surface 3*a* of the lower tank 3 and the front or rear side surface 3*b* thereof and having a bottom face which is inclined downward forwardly or rearwardly outward. Preferably, the inclined bottom face of the second portion 29*b* has an angle of inclination $\alpha$of 20 to 50 deg with a vertical plane (see FIG. 3). If this angle is less than 20 deg, the rate of flow from the first portion 29*a* to the second portion 29*b* decreases, entailing the likelihood that the condensate will collect in the first portion 29*a*. When the angle is in excess of 50 deg, the condensate is likely to flow from the first portion 29*a* to the second portion 29*b* not continuously but intermittently. The bottom face of the second portion 29*b* extends from the end of the bottom face of the first portion 29*a*. The angle of inclination of a straight line through the front and rear opposite ends of the bottom face of the first portion 29*a* with a vertical plane is preferably smaller than the angle of inclination $\alpha$ of the bottom face of the second portion 29*b* with a vertical plane. Opposite side faces defining the second portion 29*b* are inclined upwardly outward away from each other laterally of the lower tank, and the groove width of the second portion 29*b* gradually increases from the groove bottom toward the groove opening. The second portion 29*b* is the same as the first portion 29*a* in the ratio of the groove width at the bottom to the width of the opening. The second portion 29*b* is also the same as the first portion 29*a* with respect to the depth.

Each groove 29 has a third portion 29*c* existing on the front or rear side surface 3*b* of the lower tank 3 and having a vertical bottom face. The third portion 29*c* of the groove 29 is preferably 0.3 to 0.8 mm in depth. The groove third portion 29*c* has the same width from the bottom of the groove 29 to the opening thereof, and is preferably 0.5 to 1.5 mm in width. If the depth and width of the third portion 29*c* are outside the above ranges, it is difficult for the water condensate to flow into the third portion 29*c*, and the condensate will flow down at a reduced rate, hence the likelihood of impaired drainage.

The lower tank 3 comprises a platelike upper member 31 made of aluminum brazing sheet, a lower member 32 made of bare aluminum extrudate, and aluminum caps 33 for closing left and right opposite end openings.

With reference to FIGS. 7 and 8, the upper member 31 has a circular-arc cross section bulging upward at its midportion with respect to the forward or rearward direction and is provided with a depending wall 31*a* formed at each of the front and rear side edges thereof integrally therewith and extending over the entire length of the member 31. The upper surface of the upper member 31 serves as the top surface 3*a* of the lower tank 3, and the outer surface of the depending wall 31*a* as the front or rear side surface 3*b* of the lower tank 3. The grooves 29 are formed in each of the front and rear side portions of the upper member 31 and extend from the highest portion 28 in the midportion of the member 31 with respect to the forward or rearward direction to the lower end of the depending wall 31*a*. In each of the front and rear side portions of the upper member 31 other than the highest portion 28 in the midportion thereof, tube insertion holes 34 elongated in the forward or rearward direction are formed between respective adjacent pairs of grooves 29. Each corresponding pair of front and rear tube insertion holes 34 are in the same position with respect to the lateral direction. The upper member 31 has a plurality of through holes 35 formed in the highest portion 28 in the midportion thereof and arranged laterally at a spacing.

The depending walls 31*a*, grooves 29, tube insertions holes 34 and through holes 35 of the upper member 31 are formed at the same time by making the member 31 from an aluminum brazing sheet by press work.

The lower member 32 is generally w-shaped in cross section and opened upward, and comprises front and rear two walls 36, 37 curved upwardly outwardly forward and rearward, respectively, and extending laterally, a vertical intermediate wall 38 dividing the interior of the lower tank 3 into front and rear two spaces, and two connecting walls 39 integrally connecting the intermediate wall 38 to the respective front and rear walls 36, 37 at their lower ends. Each connecting wall 39 is made integral with the intermediate wall 38 by a curved portion which is curved upwardly as this potion extends forwardly or rearwardly inward. The outer surfaces of the connecting walls 39 and those of the curved portions provide the bottom surface 3*c* of the lower tank 3, and the outer surfaces of the front and rear walls 36, 37 each provide a junction 3*e* of the bottom surface 3*c* and the front or rear side surface 3*b*. The front and rear walls 36, 37 have respective ridges 36*a*, 37*a* each projecting upward from the inner edge of the upper end thereof and extending over the entire length of the wall. The intermediate wall 38 has an upper end projecting upward beyond the upper ends of the front and rear walls 36, 37, and is provided with a plurality of projections 38*a* projecting upward from the upper edge of the wall 38 integrally therewith, arranged laterally at a spacing and to be fitted into the respective through holes 35 in the upper member 31. The intermediate wall 38 has refrigerant passing cutouts 38*b* formed in. the upper edge thereof between respective adjacent pairs of projections 38*a*. The projections 38*a* and the cutouts 38*b* are formed by cutting away specified portions of the intermediate wall 38.

The upper and lower members 31, 32 are brazed to each other with the projections 38*a* of the lower member 32 inserted through the respective holes 35 in crimping engagement with the member 31 and with the depending walls 31*a* of the upper member 31 engaged with the ridges 36*a*, 37*a* of the lower member 32. The portion of the resulting assembly forwardly of the intermediate wall 38 of the lower member 32 serves as a refrigerant inflow header 41, and the portion thereof rearward from the intermediate wall 38 as a refrigerant outflow header 42. The interior of the inflow header 41 is held in communication with that of the outflow header 42 by the cutouts 38*b*.

The caps 33 are made from a bare material as by press work, forging or cutting, each have a recess facing laterally inward for the corresponding ends of the upper and lower members 31, 32 to fit in, and are brazed to the upper and lower members 31, 32 with a sheet of brazing material.

The heat exchange tubes 4 providing the front and rear tube groups 5 are each made of a bare material in the form of an aluminum extrudate. Each tube 4 is flat, has a large width in the forward or rearward direction and is provided in its interior with a plurality of refrigerant channels 4*a* extending longitudinally of the tube and arranged in parallel. The tube 4 has front and rear opposite end walls which are each in the form of an outwardly bulging circular arc. Each corresponding pair of heat exchange tube 4 of the front tube group 5 and heat exchange tube 4 of the rear tube group 5 are in the same position with respect to the lateral direction.

Preferably, the heat exchange tube 4 is 0.75 to 1.5 mm in height, i.e., in thickness in the lateral direction, 12 to 18 mm in width in the forward or rearward direction, 0.175 to 0.275 mm in the wall thickness of the peripheral wall thereof, 0.175 to 0.275 mm in the thickness of partition walls separating refrigerant channels 4*a* from one another, 0.5 to 3.0 mm in the pitch of partition walls, and 0.35 to 0.75 mm in the radius of curvature of the outer surfaces of the front and rear opposite end walls.

In place of the heat exchange tube 4 of aluminum extrudate, an electric resistance welded tube of aluminum may be used which has a plurality of refrigerant channels formed therein by inserting inner fins into the tube. Also usable is a tube which is made from a plate prepared from an aluminum brazing sheet having an aluminum brazing material layer on opposite sides thereof by rolling work and which comprises two flat wall forming portions joined by a connecting portion, a side wall forming portion formed on each flat wall forming portion integrally therewith and projecting from one side edge thereof opposite to the connecting portion, and a plurality of partition forming portions projecting from each flat wall forming portion integrally therewith and arranged at a spacing widthwise thereof, by bending the plate to the shape of a hairpin at the connecting portion and brazing the side wall forming portions to each other in butting relation to form partition walls by the partition forming portions. The corrugated fins to be used in this case are those made from a bare material.

The corrugated fin 6 is made from an aluminum brazing sheet having a brazing material layer on opposite sides thereof by shaping the sheet into a wavy form. Louvers 6*a* are formed as arranged in parallel in the forward or rearward direction in the portions of the wavy sheet which connect crest portions thereof to furrow portions thereof. The corrugated fins 6 are used in common for the front and rear tube groups 5. The width of the fin 6 in the forward or rearward direction is approximately equal to the distance from the front edge of the heat exchange tube 4 in the front tube group 5 to the rear edge of the corresponding heat exchange tube 4 in the rear tube group 5. It is desired that the corrugated fin 6 be 7.0 mm to 10.0 mm in fin height, i.e., the straight distance from the crest portion to the furrow portion, and 1.3 to 1.8 mm in fin pitch, i.e., the pitch of connecting portions.

The evaporator 1 is fabricated by tacking the components together in combination and collectively brazing the tacked assembly.

Along with a compressor and a condenser, the evaporator 1 constitutes a refrigeration cycle, which is installed in vehicles, for example, in motor vehicles for use as an air conditioner.

With reference to FIG. 9 showing the evaporator 1 described, a two-layer refrigerant of vapor-liquid mixture phase flowing through a compressor, condenser and pressure reduction means enters the refrigerant inflow header 25 of the upper tank 2 via the refrigerant inlet 27*a* of the refrigerant inlet-outlet member 27 and the refrigerant inflow opening 12*a* of the right cap 12. The refrigerant dividedly flows into the refrigerant channels 4*a* of the heat exchange tubes 4 of the front tube group 5, flows down the channels 4*a* into the refrigerant inflow header 41 of the lower tank 3. The refrigerant then flows through the cutouts 38*b* into the refrigerant outflow header 42, dividedly moves into the refrigerant channels 4*a* of the heat exchange tubes 4 of the rear tube group 5, and passes upward through the channels 4*a* into the portion of the refrigerant outflow header 26 of the upper tank 2 below the uneven flow preventing resistance plate 17. Subsequently, the refrigerant flows through the refrigerant passing holes 18, 18A of the plate 17, enters the upper portion of the outflow header 26 above the plate 17 and flows out through the refrigerant outflow opening 12*b* of the cap 12 and the refrigerant outlet 27*b* of the refrigerant inlet-outlet member 27. While flowing through the refrigerant channels 4*a* of the heat exchange tubes 4 of the front tube group 5 and the refrigerant channels 4*a* of the heat exchange tubes 4 of the rear tube group 5, the refrigerant is subjected to heat exchange with air flowing through the air passing clearances in the direction of arrow X shown in FIG. 1 and flows out of the evaporator 12 in a vapor phase. While flowing in the mode described above, the refrigerant is allowed to flow from the refrigerant inflow header 25 of the upper tank 2 into the heat exchange tubes 4 of the front tube group 5 and to flow from the refrigerant outflow header 42 of the lower tank 3 into the heat exchange tubes 4 of the rear tube group 5, in the form of uniformly divided streams by virtue of the function of the uneven flow preventing resistance plate 17.

At this time, water condensate is produced on the surfaces of the corrugated fins 6, and the condensate flows down the top surface 3*a* of the lower tank 3. The condensate flowing down the tank top surface 3*a* enters the first portions 29*a* of the grooves 29 by virtue of a capillary effect, flows through the grooves 29 and falls off the lower ends of the groove third portions 29*c* to below the lower tank 3. This prevents a large quantity of condensate from collecting between the top surface 3*a* of the lower tank 3 and the lower ends of the corrugated fins 6, consequently preventing the condensate from freezing due to the collection of large quantity of the condensate, whereby inefficient performance of the evaporator 1 is precluded.

According to the first embodiment described, each of the grooves 29 has a flat bottom face, whereas this structure of grooves is not limitative. Each groove may have a bottom face shaped to a circular-arc cross section which is recessed toward a widthwise midportion of a bottom of the groove. Preferably, the bottom face of the groove is then given a radius of curvature which is ½ of the width of the bottom of the groove. In this case, the term the "depth of the groove 29" refers to the depth thereof at the midportion of the bottom.

Further according to the first embodiment described, each of the grooves 29 comprises first to third portions 29*a* to 29*a*, whereas this groove construction is not limitative; the groove may have a first portion 29*a* extending to the junction 3*d* of the top surface 3*a* and the front or rear side surface 3*b*, and a third portion 29*c* joined to the outer end of this portion 29*a* without having any second portion 29*b*. Stated more specifically, when seen in longitudinal section, the groove may comprise a first portion 29*a* having a bottom face which is in the form of a circular arc extending from the highest portion (28) side of the top surface 3*a* of the lower tank 3 forwardly or rearwardly outward as curved downward, and a third portion 29*c* joined directly to the outer end of the first portion 29*a*, formed in the front or rear side surface 3*b* of the lower tank 3 and having a vertical bottom face.

Figure 10:
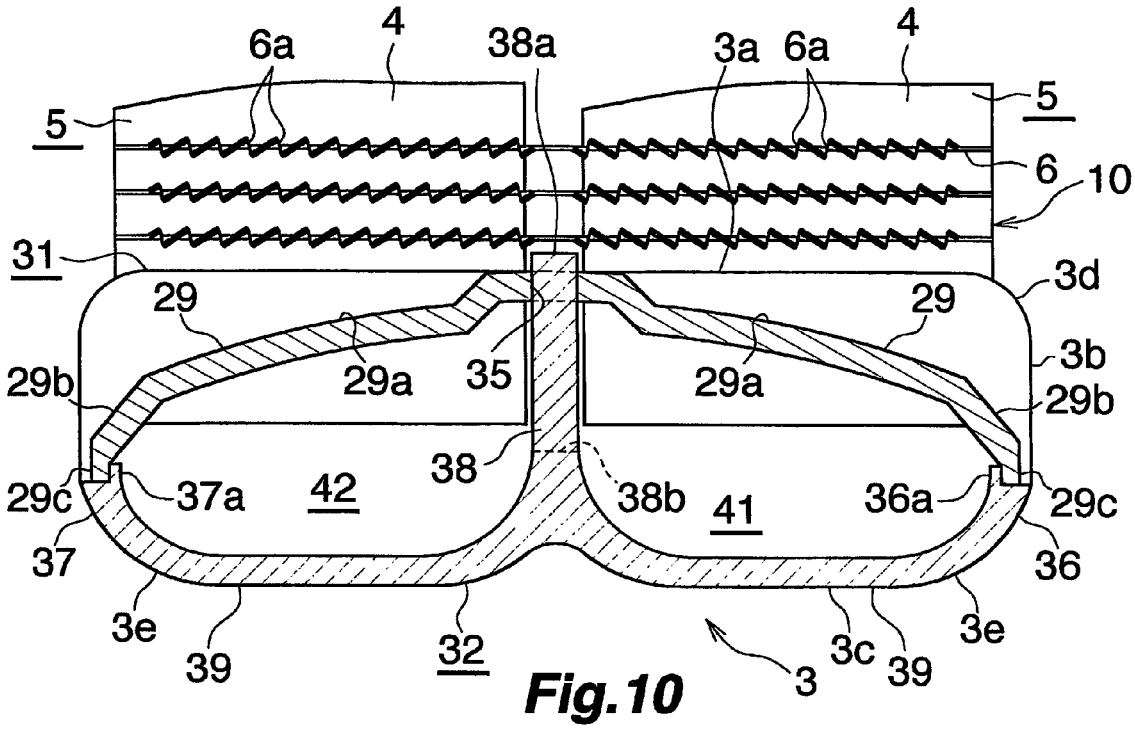
FIG. 10 is a sectional view corresponding to a portion of FIG. 3 and showing a second embodiment of evaporator of the invention.

FIG. 10 shows a second embodiment of the invention.

In the case of the embodiment of FIG. 10, the lower tank 3 has a horizontal flat top surface 3*a*. The lower tank 3 is provided, in each of the front and rear side portions thereof, with a plurality of grooves 29 extending from the midportion of the top surface 3*a* with respect to the forward or rearward direction toward the front or rear side surface 3*b*, comprising a first portion 29*a*, second portion 29*b* and third portion 29*c*, and arranged laterally at a spacing. Since the top surface 3*a* of the lower tank 3 is horizontal and flat, the upper member 31 is also different in shape from that of the first embodiment. With the exception of the above features, the second embodiment is the same as the first.

Figure 11:
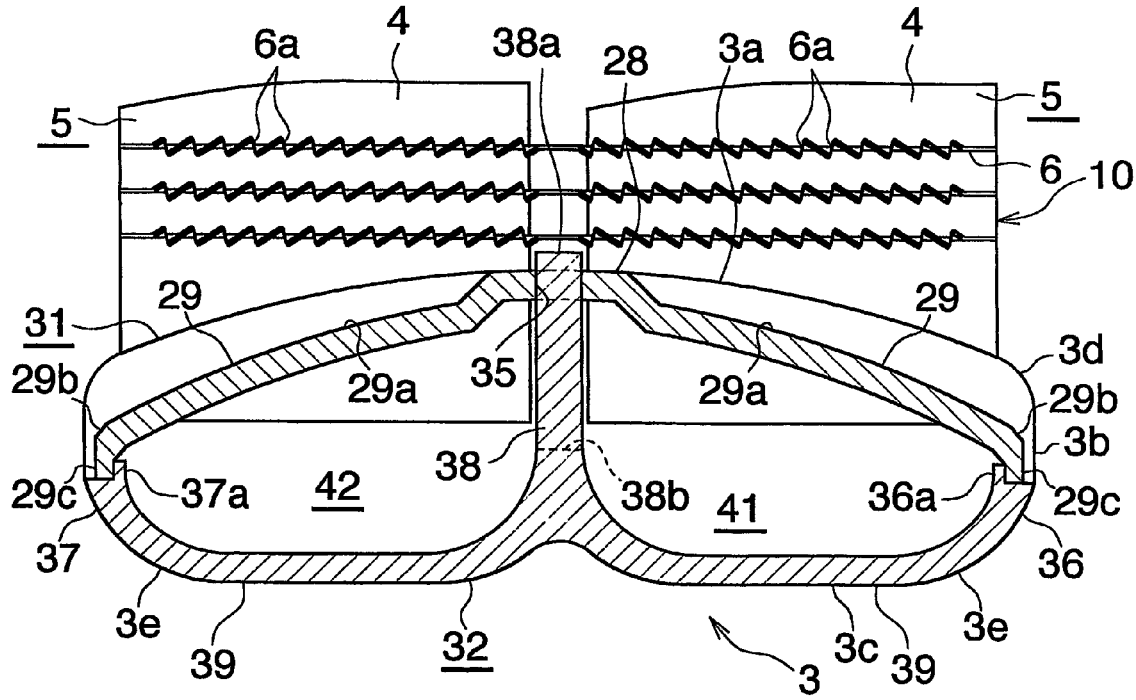
FIG. 11 is a sectional view corresponding to a portion of FIG. 3 and showing a third embodiment of evaporator of the invention.

FIG. 11 shows a third embodiment of the invention.

The embodiment of FIG. 11 has grooves 29 each comprising a first portion 29*a* existing on the top surface 3*a* of the lower tank 3 and having a depth gradually increasing as the groove extends from the highest portion (28) side of the top surface 3*a* toward the front or rear side edge. Accordingly, the second portion 29*b* existing at the junction of the lower tank top surface 3*a* and each of the front and rear opposite side surfaces 3*b* has a shortened length. With the exception of this feature, the third embodiment is the same as the first.

Figure 12:
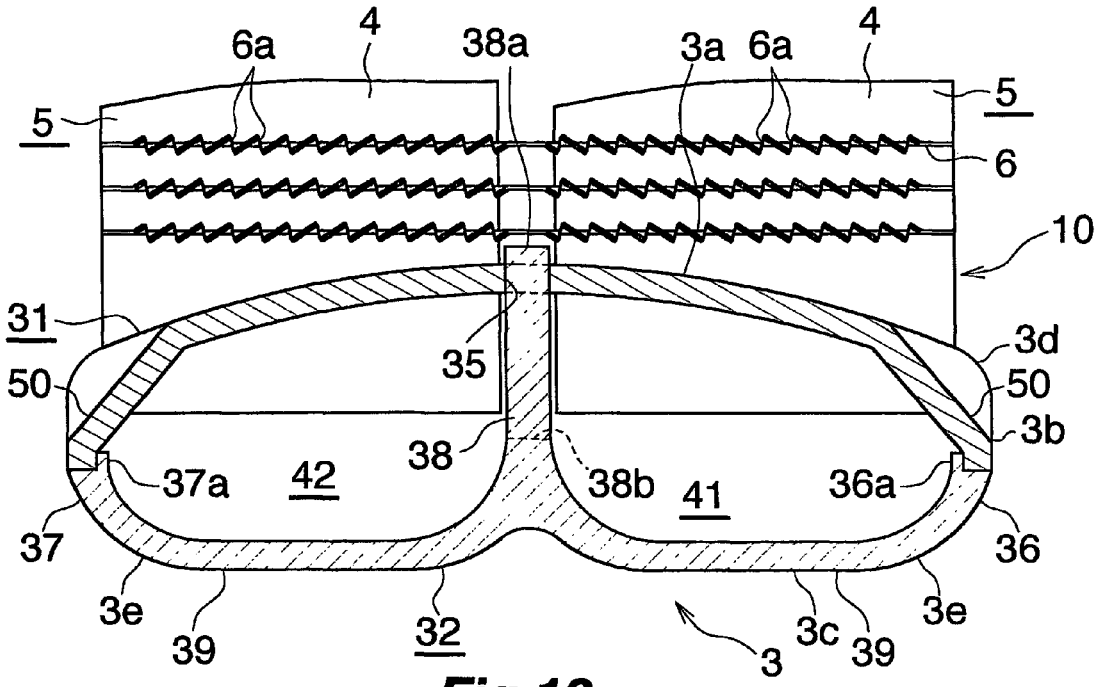
FIG. 12 is a sectional view corresponding to a portion of FIG. 3 and showing a fourth embodiment of evaporator of the invention.

FIG. 12 shows a fourth embodiment of the invention. With reference to FIG. 12, the junction 3*d* of the top surface 3*a* of the lower tank 3 and each of the front and rear opposite side surfaces 3*b* is provided with a plurality of grooves 50 arranged laterally at a spacing. Each groove 50 has a bottom face slanting downward as the groove extends forwardly or rearwardly outward. Thus, the junction 3*d* of the lower tank top surface 3*a* and the side surface 3*b* is provided with the grooves 50 which are similar to the second portion 29*b* of the first embodiment. With the exception of this feature, the fourth embodiment is the same as the first.

Figure 13:
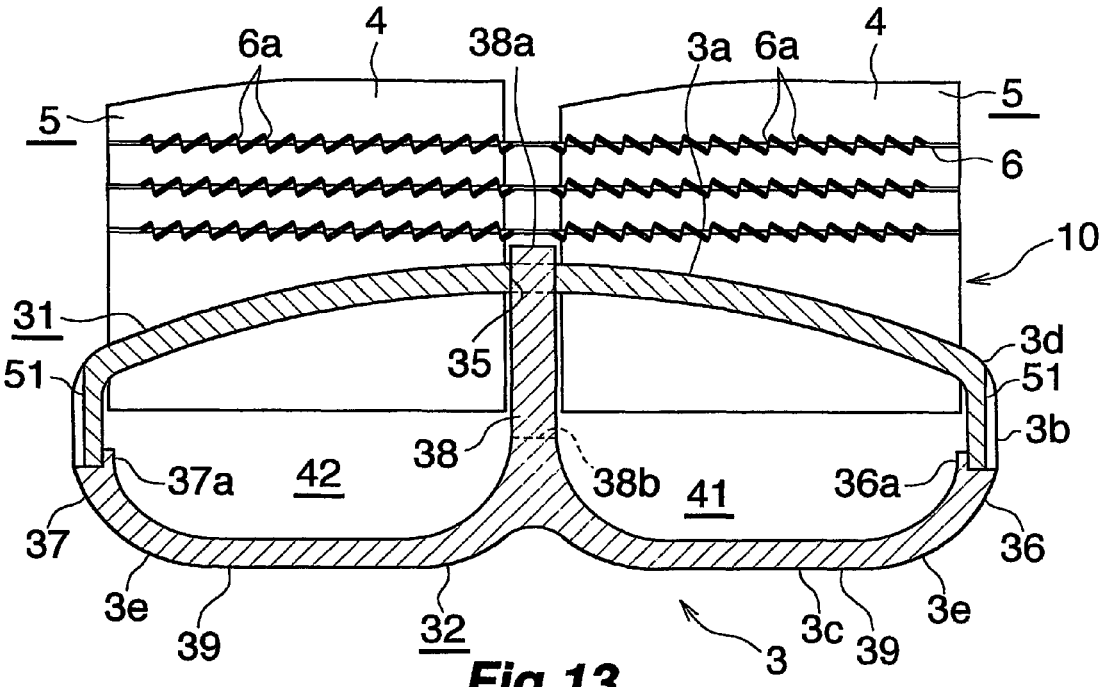
FIG. 13 is a sectional view corresponding to a portion of FIG. 3 and showing a fifth embodiment of evaporator of the invention.

FIG. 13 shows a fifth embodiment of the invention.

With reference to FIG. 13, the front and rear opposite side surfaces 3*b* of the lower tank 3 are each provided with a plurality of grooves 51 extending vertically and arranged laterally at a spacing. Each groove 51 has a vertical bottom face. Thus, each side surface 3*b* of the lower tank 3 is provided with grooves 51 similar to the third portion 29*c* of the first embodiment. The groove 51 is the same as the third portion 29*c* of the first embodiment with respect to the width and depth. With the exception of this feature, the fifth embodiment is the same as the first.

Figure 14:
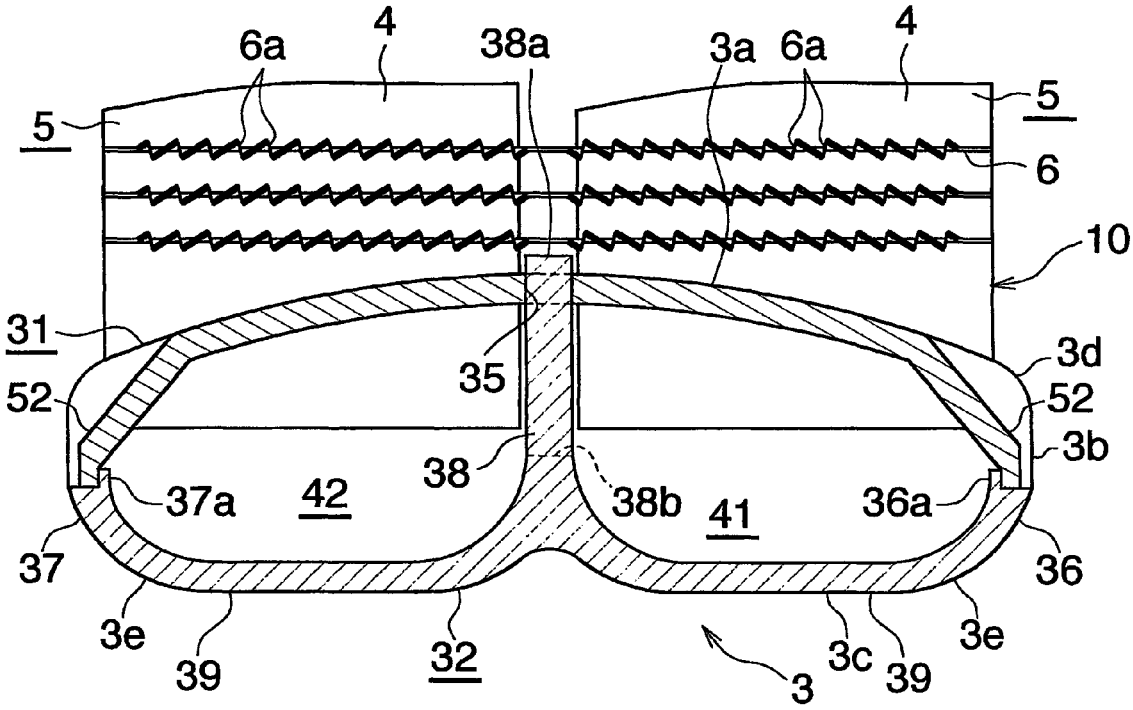
FIG. 14 is a sectional view corresponding to a portion of FIG. 3 and showing a sixth embodiment of evaporator of the invention.

FIG. 14 shows a sixth embodiment of the invention. With reference to FIG. 14, a plurality of grooves 52 extend from the junction 3*d* of the top surface 3*a* of the lower tank 3 and each of the front and rear opposite side surfaces 3*b* thereof and are arranged laterally at a spacing. Each groove 52 has a portion existing at the junction 3*d* of the top surface 3*a* and the side surface 3*b* and having a bottom face slanting downward forwardly or rearwardly outward. The groove 52 includes a portion existing on the side surface 3*b* of the lower tank 3 and having a vertical bottom face. Thus, the groove 52 is similar to a groove comprising the second portion 29*b* and third portion 29*c* of the groove 29 of the first embodiment. With the exception of this feature, the sixth embodiment is the same as the first.

According to the first to sixth embodiments described, one tube group 5 is provided in each of the front and rear side portions of a space between the upper and lower tanks 2, 3, whereas this arrangement is not limitative; one or at least two tube groups 5 may be provided in each of these side portions between the tanks 2, 3. Further although the highest portion 28 is positioned at the midportion of the lower tank 3 with respect to the forward or rearward direction according to the first to sixth embodiments, the highest portion may be positioned away from the above midportion. In this case, one or at least two tube groups may be provided at each of front and rear sides of the highest portion.

A groove continuous with each groove may be provided on the outer surface of each of the front and rear opposite walls 36, 37 included in the lower member 32 of the lower tank 3 according to the first to third, fifth and sixth embodiments.

Figure 15:
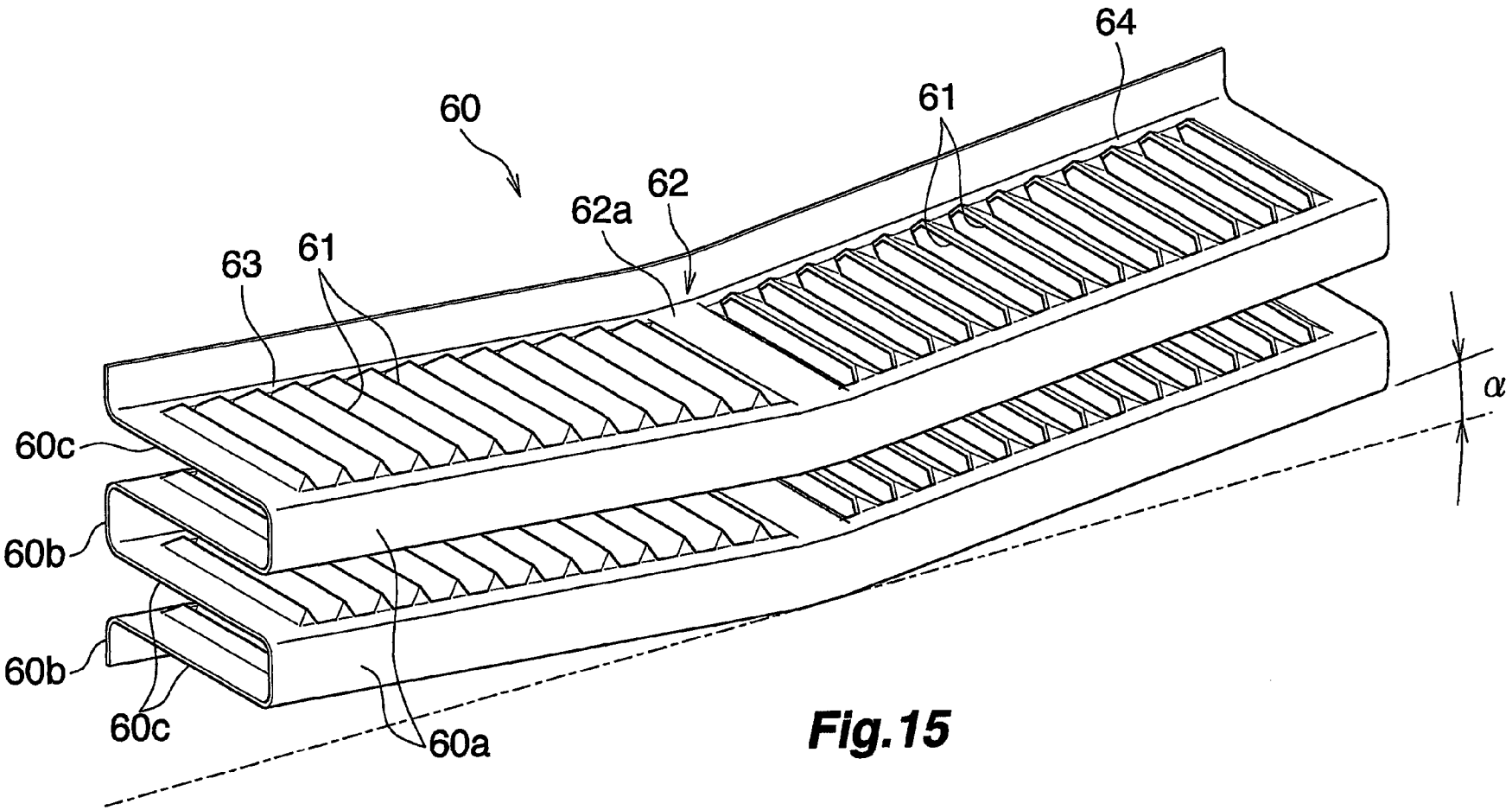
FIG. 15 is a fragmentary perspective view showing a modified corrugated fin.
Figure 16:
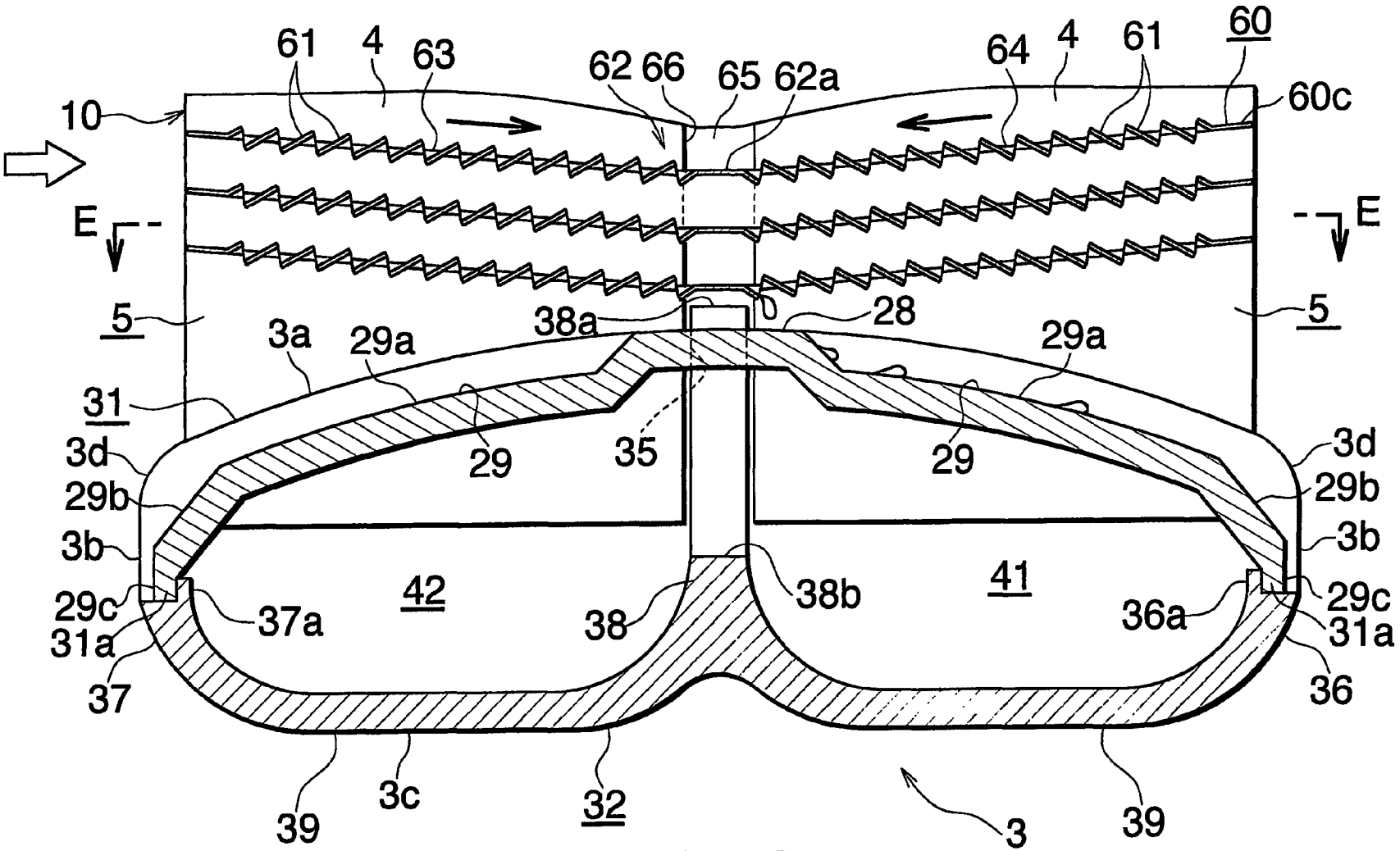
FIG. 16 is a sectional view corresponding to a portion of FIG. 3 and showing an evaporator comprising the corrugated fin of FIG. 15.
Figure 17:
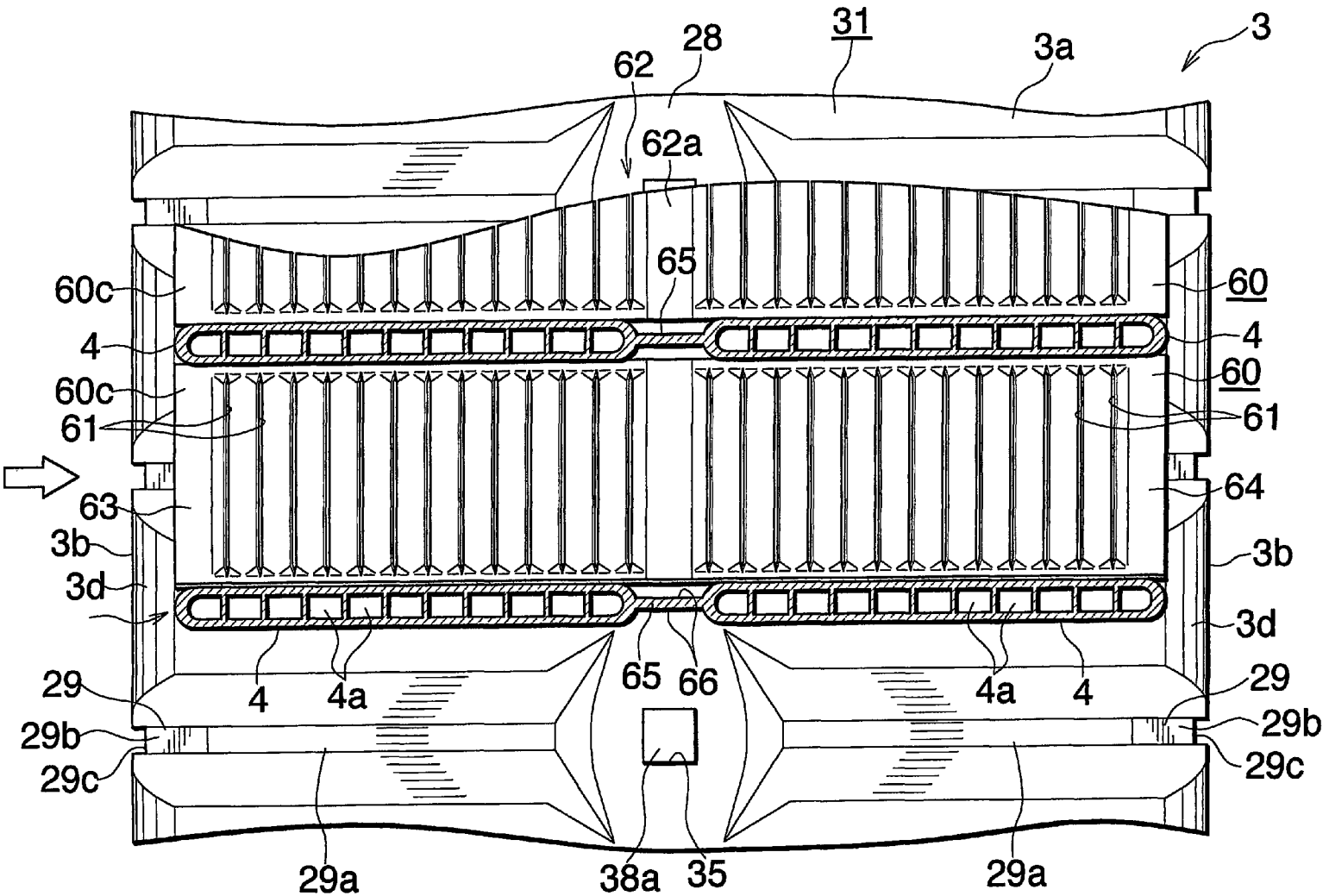
FIG. 17 is a view in section taken along the line E-E in FIG. 16.

FIGS. 15 to 17 show a modified corrugated fin.

With reference to FIG. 15, a corrugated fin 60 is made from an aluminum brazing sheet having a brazing material layer on opposite sides, by shaping the sheet into a wavy form. The fin has crest portions 60*a*, furrow portions 60*b* connected to the crest portions 60*a* by connecting portions 60*c* which are louvered as at 61 and each of which has a generally V-shaped trough part 62 formed at the midportion thereof with respect to the forward direction (direction of flow of air) by bending the connecting portion 60*c*. The connecting portion 60*c* has a slanting part 63 inclined downward from the upstream end (rear end) of this portion with respect to the direction of flow of air toward a horizontal bottom 62*a* having a predetermined width of the trough part 62, and a slanting part 64 inclined downward from the downstream end (front end) of this portion with respect to the direction of flow of air toward the trough bottom 62*a*. The slanting part 63 is opposite to the other slanting part 64 with respect to the slanting direction of louvers 61. Like the connecting portions 60*c*, the crest portions 60*a* and the furrow portions 60*b* are similarly bent, and the brazed joint between the crest portion 60*a* or the furrow portion 60*b* and the heat exchange tube 4 joined thereto is also inclined like the slanting parts 63, 64. Preferably, the angle of inclination $\alpha$ of the slanting parts 63, 64 with a horizontal plane is 2 to 10 deg, because if the angle $\alpha$ is less than 2 deg, it is difficult for the water condensate produced on the corrugated fins 60 to flow toward the trough bottom 62*a*, and also because if the angle is in excess of 10 deg, increased resistance to the flow of air will result. When the angle of inclination $\alpha$ is in the above range, the slanting angle of the louvers 61 with a horizontal is within the range of slanting angle of louvers with a horizontal which louvers are provided on conventional corrugated fins having flat connecting portions.

In the case where the corrugated fin 60 described is to be used, each forwardly or rearwardly adjacent pair of heat exchange tubes 4 have their intermediate portions (with respect to the direction of thickness of the tubes 4, i.e., lateral direction) connected together by a fastening plate member 65 as shown in FIGS. 16 and 17, whereby a drain channel 66 is provided between the front and rear adjacent tubes 4 on each of left and right sides of the fastening member. In the illustrated case, the fastening member 65 is extruded integrally with the front and rear heat exchange tubes 4, whereas a member separate from the front and rear tubes 4 may alternatively be used for and brazed to the two tubes 4 to thereby provide a drain channel between the front and rear tubes 4 on each of opposite sides of the brazed member.

The corrugated fin 60 is so disposed that the trough bottom 62*a* will be positioned in corresponding relation with the drain channel 66.

When water condensate is produced on the surface of the corrugated fin 60 as used in an evaporator, the condensate acts to flow toward the trough bottom 62*a* along the slanting parts 63, 64 of the connecting portion 60*c* under gravity, and falls off through the clearances between louvers 61. The condensate also flows along louvers 61 to the heat exchange tubes 4 on opposite sides, further flowing down in the direction of inclination along the joints between the fin 60 and the tubes 4 and falling through the clearances between louvers 61 while flowing down in this way. Additionally, the condensate portion reaching the trough bottom 62*a* enters the drain channel 66 between the front and rear heat exchange tubes 4 and flows down the drain channel 66. In this way, the condensate flows down onto the top surface 3*a* of the lower tank 3. The evaporator is therefore drained of the condensate with an improved efficiency without permitting the condensate to scatter from the air flow downstream end of the evaporator or to close the clearances between louvers 61 due to surface tension, and is consequently prevented from exhibiting impaired refrigeration performance.

The condensate flowing down onto the top surface 3*a* of the lower tank 3 is run off in the manner as in the case of the first embodiment described.

Although the corrugated fin 60 is shown in FIGS. 16 and 17 as it is used in the evaporator 1 according to the first embodiment, the corrugated fin 60 shown in FIG. 15 is applicable also to evaporators comprising a lower tank 3 which has grooves according to any one of the second to sixth embodiments.

INDUSTRIAL APPLICABILITY

The invention provides an evaporator which is suitable for use in motor vehicle air conditioners and which is adapted to reduce the quantity of water condensate to be produced on the top surface of its lower tank

The invention claimed is:

1. An evaporator comprising:

a heat exchange core comprising a plurality of tube groups arranged in rows as spaced forwardly or rearwardly of the evaporator and each comprising a plurality of heat exchange tubes arranged in parallel at a spacing laterally of the evaporator; and a lower tank disposed at a lower end of the core and having connected thereto lower ends of the heat exchange tubes providing the tube groups, wherein the lower tank has a top surface, front and rear side surfaces and a bottom surface, the top surface of the lower tank is highest at an intermediate portion and is so shaped as to lower gradually from a highest portion toward the front and rear side surfaces, the highest portion of the top surface is positioned between a front heat exchange tube row and a rear heat exchange tube row of the heat exchange core, the lower tank is provided in each of front and rear side portions thereof with front and rear grooves formed between respective laterally adjacent pairs of heat exchange tubes and extending from the intermediate portion of the top surface with respect to forward and rearward directions to the front and rear side surfaces for causing water condensate to flow therethrough, a rear end of the front groove is positioned before a rear side of the heat exchange tubes in the front heat exchange tube row, and a front end of the rear groove is positioned behind a front side of the heat exchange tubes in the rear heat exchange tube row.

2. An evaporator according to claim 1 wherein the grooves have a capillary effect to draw the condensate on the surface of the lower tank into the groove.

3. An evaporator according to claim 1 wherein each of the grooves includes a first portion existing on the top surface of the lower tank, and the first portion has a bottom face gradually lowered from the inner portion in respect to the front or rear direction forwardly or rearwardly outward.

4. An evaporator according to claim 1 wherein each of the grooves includes a first portion existing on the lower tank top surface, and the first portion has the same depth over the entire length of the first portion.

5. An evaporator according to claim 1 wherein each of the grooves includes a first portion existing on the lower tank top surface, and the first portion has a depth gradually increasing from the highest portion side of the top surface toward the side surface.

6. An evaporator according to claim 1 wherein each of the grooves includes a first portion existing on the lower tank top surface, and the first portion has a depth of 0.5 to 2.0 mm.

7. An evaporator according to claim 1 wherein each of the grooves includes a first portion existing on the lower tank top surface, and the first portion has a groove width gradually increasing from a bottom of the groove toward an opening thereof.

8. An evaporator according to claim 7 wherein the first portion of each groove is 0.067 to 0.33 in the ratio L1/L2 of the width L1 of the groove bottom to the width L2 of the opening.

9. An evaporator according to claim 1 wherein the top surface of the lower tank is in the form of a horizontal flat surface.

10. An evaporator according to claim 9 wherein each of the grooves includes a first portion existing on the lower tank top surface, and the first portion has a groove width gradually increasing from a bottom of the groove toward an opening thereof.

11. An evaporator according to claim 1 wherein each of the grooves has a flat bottom face.

12. An evaporator according to claim 1 wherein each of the grooves has a bottom face shaped to a circular-arc cross section which is recessed toward a widthwise midportion of a bottom of the groove.

13. An evaporator according to claim 12 wherein the bottom face of each groove has a radius of curvature which is ½ of the width of the groove bottom.

14. An evaporator according to claim 1 wherein each of the grooves has a first portion existing on the lower tank top surface, and the ratio W2/W1 of the straight distance W2 between front and rear ends of the first portion to the entire width W1 of the lower tank in the forward or rearward direction is 0.16 to 0.47.

15. An evaporator according to claim 1 wherein each of the grooves includes a second portion existing at a junction of the top surface of the lower tank and the side surface thereof, and the second portion has a bottom face inclined downward forwardly or rearwardly outward.

16. An evaporator according to claim 15 wherein the bottom face of the second portion of each groove has an angle of inclination of 20 to 50 deg with a vertical plane.

17. An evaporator according to claim 15 wherein each of the grooves includes a first portion existing on the top surface of the lower tank and having a bottom face, and in a longitudinal section of the groove, the bottom face of the first portion is shaped in the form of a circular arc extending from the highest portion side of the top surface of the lower tank forwardly or rearwardly outward as curved downward, the angle of inclination of a straight line through front and rear ends of the first portion bottom face with a vertical plane being smaller than the angle of inclination of the second portion bottom face with a vertical plane.

18. An evaporator according to claim 1 wherein each of the grooves includes a third portion existing on the side surface of the lower tank, and the third portion has a vertical bottom face.

19. An evaporator according to claim 18 wherein each of the grooves includes a third portion existing on the side surface of the lower tank, and the third portion has a depth of 0.3 to 0.8 mm.

20. An evaporator according to claim 18 wherein each of the grooves has a third portion having the same width from a bottom of the groove to an opening thereof.

21. An evaporator according to claim 20 wherein the third portion of each groove has a width of 0.5 to 1.5 mm.

22. A refrigeration cycle comprising a compressor, a condenser and an evaporator, the evaporator comprising an evaporator according to claim 1.

23. A vehicle having installed therein a refrigeration cycle according to claim 22 as an air conditioner.

* * * * *